US012774828B2

(12) United States Patent
Nesreddine et al.

(10) Patent No.: US 12,774,828 B2
(45) Date of Patent: Oct. 27, 2026

(54) SYSTEM AND METHOD FOR HEATING OR COOLING EMPLOYING HEAT PUMP

(71) Applicants: VILTER MANUFACTURING LLC, Cudahy, WI (US); Hydro-Québec, Montreal (CA)

(72) Inventors: Hakim Nesreddine, Trois-Riviéres (CA); Jonathan Bouchard, Shawinigan (CA); Rachid Laouamer, Trois-Riviéres (CA); Mélissa Lemire, Shawinigan (CA); Tom Marynowski, Trois-Riviéres (CA); Dominique Monney, Sainte-Julie (CA)

(73) Assignees: Copeland Industrial LP, St. Louis, MO (US); Hydro-Québec, Montreal (CA)

( * ) Notice: Subject to any disclaimer, the term of this patent is extended or adjusted under 35 U.S.C. 154(b) by 83 days.

(21) Appl. No.: 18/833,306

(22) PCT Filed: Feb. 3, 2022

(86) PCT No.: PCT/US2022/015033
§ 371 (c)(1),
(2) Date: Jul. 25, 2024

(87) PCT Pub. No.: WO2023/149879
PCT Pub. Date: Aug. 10, 2023

(65) Prior Publication Data
US 2025/0116417 A1 Apr. 10, 2025

(51) Int. Cl.
*F24F 11/83* (2018.01)

(52) U.S. Cl.
CPC ..... *F24F 11/83* (2018.01)

(58) Field of Classification Search
CPC ..... F24F 11/83; F24F 2005/0053; F24F 2221/183; F24F 2221/54; F24F 5/0046;
(Continued)

(56) References Cited

U.S. PATENT DOCUMENTS

2010/0064710 A1 3/2010 Slaughter
2017/0010051 A1 1/2017 Connolly
2018/0283709 A1 10/2018 Al-Hallaj et al.

FOREIGN PATENT DOCUMENTS

AT 502029 A4 1/2007
CN 202204222 4/2012
(Continued)

OTHER PUBLICATIONS

WO 2009141979 A1 Translation (Year: 2009).*
(Continued)

*Primary Examiner* — Jerry-Daryl Fletcher
*Assistant Examiner* — Dario Antonio Deleon
(74) *Attorney, Agent, or Firm* — Amundsen Davis, LLC

(57) ABSTRACT

Heating and/or cooling systems, related methods, particularly those utilized for the heating and/or cooling of large structures, areas, or environments are disclosed herein. In one example embodiment, such a system includes a stratified thermal storage tank (STST), heat exchanger, and heat pump. A first amount of a fluid can flow from the STST to a heating load and then to the heat exchanger, at which residual heat can be received, and which is configured to receive a medium from an external source. The medium can flow from the source through the heat exchanger to an evaporator of the heat pump and transport first heat to the evaporator, including the residual heat. A risk of ice formation at the evaporator is reduced/eliminated. The heat pump is configured to cycle a refrigerant, so that the first heat is transferred from the evaporator to a gas cooler, and then to the STST.

20 Claims, 5 Drawing Sheets

(58) Field of Classification Search
CPC .... F24F 5/0096; F24H 15/215; F24H 15/238; F24H 15/315; F25B 5/02; F25B 25/005; F25B 2339/047; F28D 20/0039; F28D 2020/0069; F24D 2200/11; F24D 2200/123; F24D 2200/31; F24D 11/0235; F24D 17/02; F24D 19/1072; F24D 11/0214; Y02E 60/14
See application file for complete search history.

(56) References Cited

FOREIGN PATENT DOCUMENTS

| | | | | |
|---|---|---|---|---|
| CN | 105841349 | | 8/2016 | |
| CN | 108224774 | | 6/2018 | |
| CN | 112303971 | | 2/2021 | |
| DE | 202015004569 | U1 | 9/2016 | |
| JP | WO 2009141979 | A1 * | 11/2009 | ..... F24D 17/02 |
| JP | 2009281641 | A | 12/2009 | |
| WO | 2009141979 | A1 | 11/2009 | |
| WO | 2011107651 | A1 | 9/2011 | |
| WO | 2020161041 | A1 | 8/2020 | |

OTHER PUBLICATIONS

International Search Report and Written Opinion for International Application No. PCT/US2022/015033 dated Sep. 27, 2022 (52 pages).
International Search Report and Written Opinion for International Application No. PCT/US2022/015032 dated Sep. 27, 2022 (51 pages).
Jang, J. Y., Bae, H. H., Lee, S. J., & Ha, M. Y. Continuous heating of an air-source heat pump during defrosting and improvement of energy efficiency. Applied Energy, 110, pp. 9-16, published in 2013 (available online as of May 6, 2013).
Kim, J., Choi, H.-., & Kim, K. C. A combined dual hot-gas bypass defrosting method with accumulator heater for an air-to-air heat pump in cold region. Applied Energy, 147, pp. 344-352, published in 2015 (available online as of Mar. 17, 2015).
Wang, F., Wang, J., Liu, M., & Zhang, Z. The experimental study of water storage performance on small heat-pump energy storage air-conditioner. Advanced Materials Research. vol. 608-609. pp. 1133-1136, published in 2013 (available online as of Dec. 13, 2012).
Qu, M., Li, T., Deng, S., Fan, Y., & Li, Z. Improving defrosting performance of cascade air source heat pump using thermal energy storage based reverse cycle defrosting method. Applied Thermal Engineering, 121, pp. 728-736, published in 2017 (available online as of May 2, 2017).
Xiaohui She, Lin Cong, Binjian Nie, Guanghui Leng, Hao Peng, Yi Chen, Xiaosong Zhang, Tao Wen, Hongxing Yang, Yimo Luo. Energy-efficient and -economic technologies for air conditioning with vapor compression refrigeration: A comprehensive review, Applied Energy, vol. 232, pp. 157-180, published in 2018 (available online as of Oct. 3, 2018).
Ushio, Tomaki, Yoshida, Harunori and Mori, Shigemi. . Retrofit Creates Kyoto Energy Showcase. ASHRAE Journal, vol. 63 No. 9, pp. 52-56, published Sep. 2021.
Garcia, Luis Sanz, Jacquemoud, Emmanuel, Jenny, Philipp. Thermo-Economic Heat ExchangerElectro-Thermal Energy Storage Based on Transcritical Co2 Cycles. DuEPublico, Duisburg-Essen Publications online, 3rd European sCO2 Conference 2019, pp. 1-11, published Sep. 19, 2019.
Communication pursuant to Rules 161(1) and 162 EPC issued by the European Patent Office in European Patent Application No. 22712100.1, dated Mar. 27, 2025 (3 pages).
Applicant's Response to Rule 161 EPC Communication filed in European Patent Application No. 22712100.1, filed Sep. 23, 2025 (23 pages).
Office Action concerning U.S. Appl. No. 18/833,302 mailed on Feb. 11, 2026 (21 pages).
English translation of JP-2009281641-A, Year: 2009 (83 pages).
Amendment and Remarks in response to Non-Final Office Action in U.S. Appl. No. 18/833,302, filed May 8, 2026 (18 pages).

* cited by examiner

SYSTEM AND METHOD FOR HEATING OR COOLING EMPLOYING HEAT PUMP

FIELD

The present disclosure relates generally to heating and/or cooling systems and methods, including systems and methods for processing water and other industrial utilization, and more particularly to heating and/or cooling systems and methods that include heat pumps, such as those which are utilized to heat or cool large structures, areas, or environments, including (for example, but not limited to) a commercial and/or institutional building or manufacturing facility.

BACKGROUND

Various conventional systems and methods are utilized to heat (or cool) large structures, areas, or environments, such as (for example, but not limited to) a commercial and/or institutional building or manufacturing facility. Many such conventional systems and methods employ conventional heat pumps. Also, some such conventional systems and methods operate in conjunction with thermal sources such as waterways, lakes, rivers, etc.

Although such conventional systems and methods can provide adequate heating (or cooling) in some circumstances, such conventional systems and methods often suffer from one or more limitations or disadvantages. For example, due to global warming concerns, environmental regulations are becoming increasingly restrictive in order to limit greenhouse gas emissions into the environment. Thus, in the coming years, many synthetic refrigerants will be banned. However, conventional heat pumps that are utilized to heat (or cool) large structures, areas, or environments mostly use synthetic refrigerants As a consequence, conventional heat pumps that are used for these purposes may become obsolete in the coming years.

Also for example, conventional heat pumps that operate in conjunction with thermal sources such as waterways, lakes, rivers, etc. often are shut down in the winter because, for such a conventional heat pump to function, the water temperature of the water source should not be close to (or lower than) the freezing point. Consequently, during the winter or when temperatures become too low, another source of energy often is required to serve as a heat source.

Accordingly, it would be advantageous if an improved heating (or cooling) system and/or method for heating (or cooling) large structures, areas, or environments (e.g., for space heating) could be developed in which one or more of the above concerns, or one or more other concerns, could be alleviated or avoided, and/or that provided one or more advantages.

BRIEF SUMMARY

In at least some example embodiments, the present disclosure relates to a heating and cooling system configured to perform water temperature conditioning. The heating and cooling system includes a stratified thermal storage tank (STST) having an interior region extending between a first end and a second end, where the interior region includes a hot section at or proximate to the first end, a cold section at or proximate to the second end, and a thermocline section in between the hot and cold sections, and where the STST includes within the interior region a plurality of portions of a fluid respectively having successively decreasing temperatures successively distributed from the first end to the second end. Further, the system also includes first and second conduits respectively coupled to the STST at a first location along the hot section and at a second location along the thermocline section, where the first and second conduits are configured to be coupled at least indirectly to a heating load so that at least a first amount of the fluid can flow between the STST and the heating load.

Also, the system includes a first heat pump including a first evaporator and a gas cooler. A first output port of the gas cooler is coupled at least indirectly to a first additional location along the STST and a first input port of the gas cooler is coupled at least indirectly to a second additional location along the STST so that at least a second amount of the fluid can flow between the STST and the gas cooler. Further, a first input port of the first evaporator is coupled to a third additional location along the STST and a first output port of the first evaporator is coupled to a fourth additional location along the STST, so that at least a third amount of the fluid can flow between the STST and the first evaporator, where the first and fourth additional locations are respectively at or proximate to the first and second ends, respectively, and each of the second and third additional locations is between the first and fourth additional locations. Additionally, the first evaporator is coupled to the gas cooler, and the first heat pump is configured to cycle therewithin a refrigerant between the first evaporator and the gas cooler, so that first heat transported from the STST by the third amount of the fluid to the first evaporator is communicated by way of the first heat pump to the gas cooler and then transported from the gas cooler by the second amount of fluid to the hot section of the STST, whereby at least some of the first heat can be further transported by the first amount of fluid via the first conduit for receipt by the heating load.

Further, the present disclosure in at least some embodiments relates to a method of operating a heating and cooling system at least in part by performing water temperature conditioning. The method includes providing each of (a) a stratified thermal storage tank (STST) having an interior region and including within the interior region a fluid having a decreasing temperature distribution from a first end to a second end of the STST, (b) first and second conduits respectively coupled to the STST at a first location proximate the first end and at a second location along a midsection between the first and second ends, (c) first, second, third, and fourth additional conduits respectively coupled to the STST at first, second, third, and fourth additional locations along the STST, where the first and fourth additional locations are respectively at or proximate to the first and second ends, respectively, the second additional location is between the first and fourth additional locations, and the third additional location is between the second and fourth additional locations, and (d) a heat pump including a first evaporator and a first gas cooler, where a first output port of the gas cooler is coupled to the STST at least indirectly by the first additional conduit and a first input port of the first gas cooler is coupled to the STST at least indirectly by the second additional conduit, where a first input port of the evaporator is coupled to the STST at least indirectly by the third additional conduit, and where a first output port of the evaporator is coupled to the STST at least indirectly by the fourth additional conduit.

The method additionally includes causing a first amount of the fluid to flow, via the third additional conduit, from the third additional location to the first input port of the evaporator so that first heat is transported to the evaporator, and transporting the first heat by way of flowing refrigerant within the heat pump from the evaporator to the gas cooler. The method also includes causing a second amount of the fluid to flow from the second additional location to the first additional location, via the second and first additional conduits and through the gas cooler, so that the second amount of the fluid receives the first heat at the gas cooler and so that the first heat is delivered to the interior of the STST by way of the first additional location. Further, the method includes pumping a third amount of the fluid to flow from the first location via the first conduit for receipt by the heating load, so that at least a portion of the first heat is delivered to the heating load.

Also, the present disclosure in at least some embodiments relates to a heating and cooling system configured to perform water temperature conditioning. The system includes a first stratified thermal storage tank (STST) having, within an interior region thereof, a fluid having a decreasing temperature distribution from a first end to a second end of the STST. Additionally, the system includes first and second conduits respectively coupled to the STST at first and second locations, respectively, the first location being proximate the first end and the second location being along a thermocline section of the interior region between the first and second ends, where the conduits are configured to be coupled at least indirectly to a heating load so that a first amount of the fluid can flow between the STST and the heating load. Further, the system includes a mixing valve having first and second input ports respectively coupled by first and second additional conduits, respectively, to first and second additional locations along the STST, respectively, where the first and second additional locations are between the first and second ends, respectively.

Additionally, the system includes a heat pump including an evaporator and a gas cooler. A first output port of the gas cooler is coupled by a third additional conduit to a third additional location proximate the first end of the STST and a first input port of the first gas cooler is coupled to an output port of the mixing valve, so that at least a second amount of the fluid can flow between the STST and the gas cooler via the mixing valve. Also, a first input port of the evaporator is coupled to the STST at least indirectly by a fourth additional conduit and a first output port of the evaporator is coupled to the STST at least indirectly by a fifth additional conduit, so that at least a third amount of the fluid can flow between the STST and the evaporator. Further, the heat pump operates to circulate therewithin a refrigerant between the evaporator and the gas cooler in accordance with a transcritical cycle, so that first heat transported from the STST to the evaporator by the third amount of the fluid is communicated by way of the heat pump to the gas cooler and then delivered from the gas cooler by the second amount of fluid to a hot section of the interior region of the STST proximate the first end, whereby at least some of the first heat can be further transported by the first amount of fluid via the first conduit for receipt by the load.

Further, the present disclosure in at least some embodiments relates to a heating and cooling system configured to perform water temperature conditioning. The system includes a stratified thermal storage tank (STST) having an interior region extending between a first end and a second end, where the STST includes a plurality of portions of a fluid respectively having successively decreasing temperatures successively distributed from a hot section proximate the first end to a cold section proximate the second end. The system also includes first and second conduits respectively coupled to the STST at first and second locations, respectively, the first conduit also being configured to be coupled to a heating load. Further, the system includes a first heat exchanger, where the second conduit is coupled between the second location and a first output port of the first heat exchanger, and where a first intermediate conduit is coupled to a first input port of the first heat exchanger and configured to be coupled to the heating load, so that a first amount of the fluid can flow from the STST to the heating load and then to the first heat exchanger, and so that first residual heat carried by the first amount of the fluid and not absorbed by the heating load can be received by the heat exchanger.

Additionally, the system includes a heat pump including an evaporator and a gas cooler, where a first output port and a first input port of the gas cooler are respectively coupled at least indirectly to first and second additional locations, respectively, along the STST, so that a second amount of the fluid can flow from the STST to and through the first gas cooler and then return to the STST. A second input port of the first heat exchanger is configured to receive a medium from a first external source, and a second output port of the first heat exchanger is coupled to a first input port of the evaporator, so that the medium can flow from the first external source through the first heat exchanger and to the evaporator and transport first heat to the evaporator, the first heat including source heat from the first external source and the first residual heat. A risk of ice formation at or within the evaporator is reduced or eliminated due to the first residual heat transported by the medium to the evaporator. Further, the heat pump is configured to cycle therewithin a refrigerant between the evaporator and gas cooler, so that the first heat is transferred from the evaporator to the gas cooler, and from the gas cooler to the hot section of the STST proximate the first end by the second amount of the fluid, so as to be available to be further transferred to the heating load.

Further, the present disclosure in at least some embodiments relates to a method of operating a heating and cooling system at least in part by performing water temperature conditioning. The method includes providing each of (a) a stratified thermal storage tank (STST) having an interior region and including within the interior region a fluid having a decreasing temperature distribution from a first end to a second end of the STST, (b) first and second conduits respectively coupled to the STST at a first location proximate the first end and at a second location along a midsection between the first and second ends, (c) first and second additional conduits respectively coupled to the STST at first and additional locations along the STST, respectively, where the first and second additional locations are respectively at or proximate to the first and second ends, respectively, (d) a first external heat exchanger, where the second conduit is coupled between the second location and a first output port of the first external heat exchanger, where a first intermediate conduit is coupled to a first input port of the first external heat exchanger and configured to be additionally coupled at least indirectly to the heating load, and where a second input port of the first external heat exchanger is configured to be coupled at least indirectly to a first external heat source, and (e) a heat pump including a first evaporator and a first gas cooler, where a first output port of the gas cooler is coupled to the STST at least indirectly by the first additional conduit and a first input port of the first gas cooler is coupled to the STST at least indirectly by the second additional conduit, and where a first input port of the first evaporator is coupled to a second output port of the first external heat exchanger by an additional intermediate conduit.

Additionally, the method also includes extracting residual heat from a first amount of fluid received at the first input port of the first heat exchanger at least indirectly from the heating load. Further, the method includes causing the medium to flow through the first heat exchanger from the second input port to the second output port thereof, and subsequently to the first input port of the first evaporator, so that the first evaporator receives first heat including both source heat included by the medium as provided by the first external source and also the residual heat. A risk of ice formation at or within the evaporator is reduced or eliminated due to the first residual heat. Also, the method includes transporting the first heat by way of flowing refrigerant within the heat pump from the evaporator to the gas cooler. Further, the method includes causing a second amount of the fluid to flow from the second additional location to the first additional location, via the second and first additional conduits and through the gas cooler, so that the second amount of the fluid receives the first heat at the gas cooler and so that the first heat is delivered to the interior of the STST by way of the first additional location. Additionally, the method includes pumping a further amount of the fluid to flow from the first location via the first conduit for receipt by the heating load, so that at least a portion of the first heat is delivered to the heating load.

Further, the present disclosure in at least some embodiments relates to a heating and cooling system configured to perform water temperature conditioning. The system includes a first stratified thermal storage tank (STST) having an interior region and including within the interior region a fluid having a decreasing temperature distribution from a first end to a second end of the at least one STST. The system also includes first and second conduits respectively coupled to the STST at a first location proximate the first end and at a second location within a thermocline section between the first and second ends, where the first and second conduits are configured to be coupled at least indirectly to a heating load so that a first amount of the fluid can flow between the STST and the heating load. Further, the system includes a first external heat exchanger, where the second conduit is coupled between the second location and a first output port of the first external heat exchanger, where a first intermediate conduit is coupled to a first input port of the first external heat exchanger and configured to be additionally coupled to the heating load so that the first amount of the fluid carrying first residual heat not absorbed by the heating load can be received by the first external heat exchanger, and where a second input port of the first external heat exchanger is configured to be coupled at least indirectly to a first external heat source to receive a medium.

Also, the system includes a heat pump including an evaporator and a gas cooler, where a first output port of the gas cooler is coupled to a first additional location proximate the first end at least indirectly by a first additional conduit, where a first input port of the first evaporator is coupled to a second output port of the first external heat exchanger by an additional intermediate conduit so as to receive the medium after the medium passes through the first external heat exchanger, and where the heat pump operates to circulate therewithin a refrigerant between the evaporator and the gas cooler in accordance with a transcritical cycle, so that first heat communicated by the medium received at the evaporator is transported to the gas cooler. The first heat communicated by the medium includes both source heat received from the first external heat source and the first residual heat extracted by the first heat exchanger, where the first heat is additionally communicated from the first output port of the gas cooler to the STST by a second amount of the fluid flowing through the first additional conduit so as to be available for further communication to the heating load. Additionally, a risk of ice formation at or within the evaporator is reduced or eliminated due to the first residual heat transferred by the medium.

BRIEF DESCRIPTION OF THE DRAWINGS

Embodiments of systems, apparatuses, and methods are disclosed with reference to the accompanying drawings and are for illustrative purposes only. The systems, apparatuses, and methods encompassed herein are not limited in their applications to the details of construction, arrangements of components, or other aspects or features illustrated in the drawings, but rather such systems, apparatuses, and methods encompassed herein include other embodiments or are capable of being practiced or carried out in other various ways. Like reference numerals are used to indicate like components. In the drawings.

DETAILED DESCRIPTION

Figure 1:
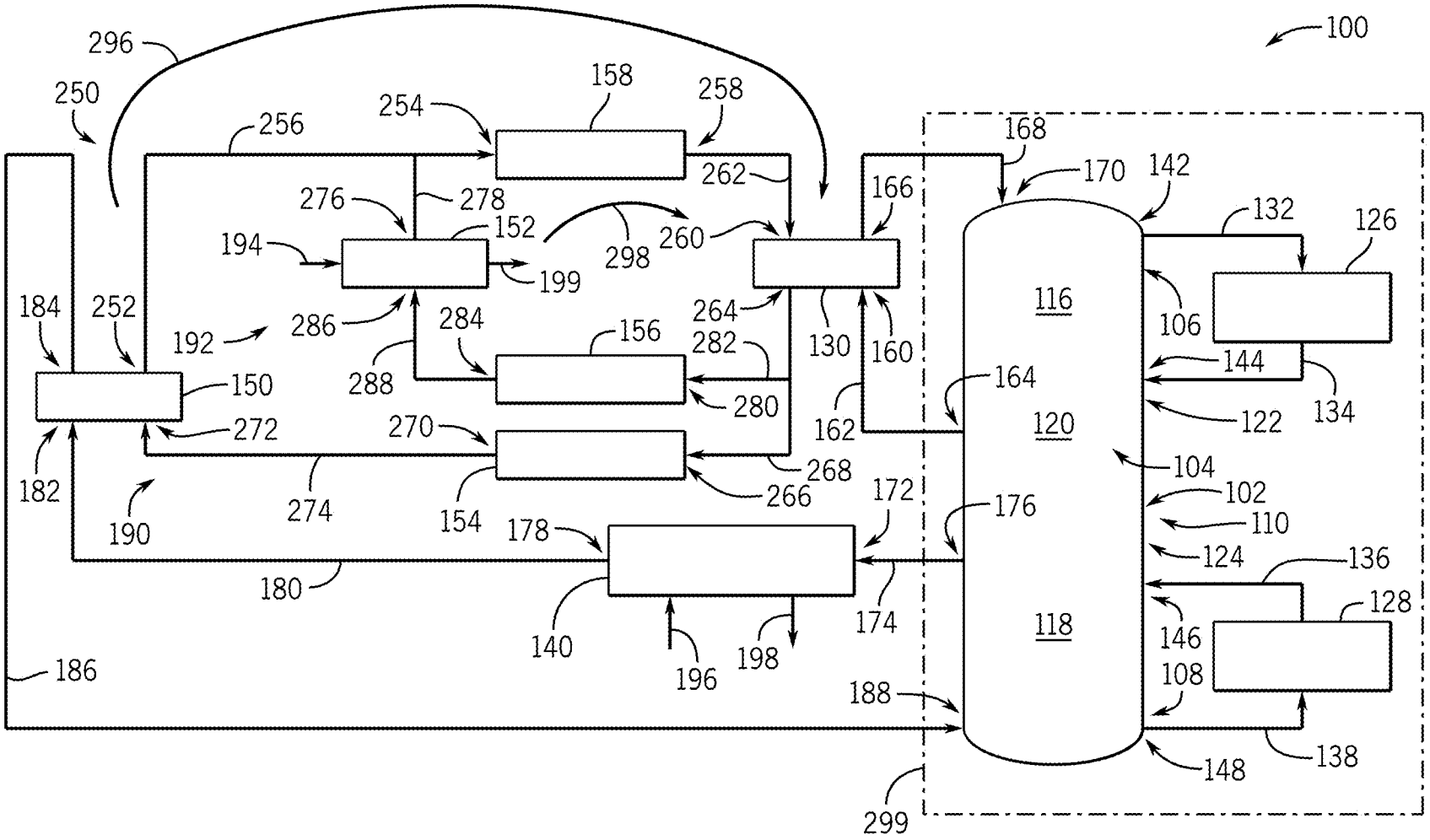
FIG. 1 is a schematic drawing showing a first system and corresponding first method for heating and/or cooling by way of water temperature conditioning, in which a stratified thermal storage tank (STST) is employed, in accordance with a first example embodiment.

The present inventors have recognized that the above concerns associated with conventional pumps being used to heat or cool large structures, areas, and environments, and particularly recognized the importance of finding alternative space heating solutions now that can utilize refrigerants other than synthetic refrigerants, for example natural refrigerants such as carbon dioxide ($CO_2$). Further, the present inventors have also recognized that, although $CO_2$ heat pumps have conventionally been considered to be not very efficient, and consequently have not been utilized for space heating (but rather have conventionally been used for and found to be especially effective for heating water for domestic use), nevertheless such heat pumps can indeed be employed for space heating or cooling purposes.

The present inventors particularly have recognized that, although $CO_2$ heat pumps have conventionally been considered appropriate for applications such as domestic water heating in which the temperature differential at the load is great (unlike a small temperature differential as exists when conventional heat pumps are used for space heating), $CO_2$ heat pumps can become more effective than conventional heat pumps by conditioning the temperature at the sink and at the source. The present inventors have further recognized that the effectiveness of a variety of heat pumps (not only $CO_2$ heat pumps) can be enhanced by conditioning the temperature at the sink and at the source, if those heat pumps use refrigerant that can operate in a transcritical cycle. Additionally, the present inventors have recognized that temperature conditioning at the source allows for a heat pump to be operated during the winter by acting as a preventive measure against the formation of ice. (Indeed, without an increase in temperature from the source to the inlet, water can form ice at its outlet since it is near the freezing point at the inlet.)

In view of these one or more of these considerations, among others, the present disclosure is intended to encompass a variety of improved heating and/or cooling systems and methods for heating or cooling large structures, areas, or environments, including (for example, but not limited to) a commercial and/or institutional building or manufacturing facility. In at least some embodiments encompassed herein, the present disclosure relates to heating and/or cooling systems that employ transcritical heat pump systems. Such a transcritical heat pump system includes a thermal storage tank, one or more compressors, one or more expansion valves, and one or more heat exchangers (e.g., one or more of an evaporator, a gas cooler and/or an external heat exchanger). The thermal storage tank can be a stratified thermal storage tank (STST), or can be multiple such STSTs that are coupled in series or in parallel with one another. That is, depending upon the embodiment, either one STST or several STSTs coupled in parallel and/or in series can be employed. Also, at least some embodiments encompassed herein use carbon dioxide ($CO_2$) heat pumps for space heating in buildings.

Further, in at least some embodiments, the heating and/or cooling systems encompassed herein employ heat pumps, where the heat pump includes both an evaporator and a gas cooler. The heat pumps can operate in accordance with a transcritical cycle that includes both a subcritical region and a supercritical region, with "supercritical" and "subcritical" being states that are attributes of the refrigerant employed by the heat pumps. The heat pumps respectively can operate in any of the following three modes (depending upon the embodiment or operational circumstance), namely: (1) in heating mode only; (2) in cooling mode only; or (3) in both (simultaneous) heating mode and cooling mode. When a heat pump is operating in accordance with this transcritical cycle, the refrigerant is in the subcritical state when the refrigerant is in the evaporator but, depending upon the operating condition, the refrigerant is either in the supercritical state or the subcritical state when the refrigerant is in the gas cooler. Additionally the present disclosure also encompasses, among other things, several (e.g., three or more) methods of conditioning the temperatures of the water at the inlet of such an evaporator and at such a gas cooler of such a system.

In at least one or more embodiments encompassed herein, the heating and/or cooling systems operate by recovering heat from a storage tank, particularly a STST (which may not be involved in the processes due to its low thermal quality). In at least some such embodiments, the storage tank acts as a heat exchanger with internal and direct contact between the heat source and/or the return of the load requiring a cold supply with the residual heat returning from the heat sink. This heat exchanger is used to increase the temperature of the heat transfer fluid (e.g., water) entering the evaporator and to cool the fluid (e.g., water) entering the gas cooler through the formation of stratification levels in the STST.

Referring now to FIG. 1, a schematic drawing is provided to illustrate a system 100 that is configured for water temperature conditioning, in accordance with an example embodiment encompass herein. As shown, the system 100 particularly operates by way of direct contact of water within a stratified thermal storage tank (STST) 102, which may be pressurized or not pressurized depending upon the embodiment. The STST 102 defines an interior chamber 104 that can be considered to have each of a hot section 106, a cold section 108, and a thermocline section (or simply thermocline) 110 positioned between the hot and cold sections (e.g., as a midsection between those hot and cold sections). The exact boundaries of the hot section 106 relative to the thermocline section 110, and between the thermocline section and the cold section 108, are not necessarily exact and may be defined somewhat arbitrarily based upon temperature variation in the STST 102. In the present embodiment, the hot section 106 is vertically above the thermocline section 110, which in turn is above the cold section 108, although this arrangement may vary depending upon the embodiment.

It should be appreciated that the STST 102 may be considered or referred to as "stratified" insofar as the water contained within the storage tank has different temperatures based upon the position or level of the water within the storage tank. In general, a first portion 116 of the water that is within the hot section 106 has a higher temperature than a second portion 118 of the water that is within the cold section 108, and a third portion 120 of the water that is within the thermocline section 110 generally is of a temperature that is in between the temperatures of the first and second portions of the water. The third portion 120 of the water that is within the thermocline section 110 particularly is a stratified part of the water, which separates the first portion 116 of the water within the hot section 106 (the hotter region) from the second portion 118 of the water within the cold section 108 (the cold region), and in which temperature(s) decreases rapidly with decreases of the height in the tank. Thus, although the present discussion particularly identifies the first, second, and third portions 116, 118, and 120 of water, it should be further recognized that further stratifications or gradations of portions of water within the interior chamber 104 also occur. For example, it should be appreciated that a first subportion 122 of the third portion 120 of the water that is within the thermocline section 110 but is closer to the hot section 106 rather than to the cold section 108 will typically have a higher temperature than a second subportion 124 of the third portion 120 of the water that is within the thermocline section 110 but is closer to the cold section 108 than to the hot section 106.

Further as shown in FIG. 1, the STST 102 is connected and configured to supply heated water to a heating load 126 as well as to supply cool (or cooled or cold) water to a cooling load 128. The heating load 126 and/or the cooling load 128 can take any of a variety of forms depending upon the embodiment or circumstance. For example, the heating load 126 can be any large structure, area, or environment that requires heat or for which heat is sought, including (for example, but not limited to) a commercial and/or institutional building or manufacturing facility requiring space heating. Likewise, the cooling load 128 can be any large structure, area, or environment that requires cooling or from which it is desired that heat be removed, including (for example, but not limited to) a commercial and/or institutional building or manufacturing facility requiring cooling, air conditioning, chilled water, or ice (such as, further for example, a cold storage facility or large refrigeration facility). As described in further detail below with respect to FIG. 4, the heating load 126 and cooling load 128 respectively can also be understood to be formed by (or primarily by) respective heat exchangers or heat transfer devices (including, for example, a heating coil or a cooling coil, respectively), which in turn can give off heat or extract heat, respectively, in relation to a larger structure, area, or environment as part of an overall heating, ventilation, and air conditioning (HVAC) system.

In the present embodiment of FIG. 1, the heating load 126 is coupled to the STST 102 by way of a first conduit 132 and a second conduit 134, and the cooling load 128 is coupled to the STST by way of a third conduit 136 and a fourth conduit 138. Each of the conduits 132, 134, 136, and 138, as well as other conduits referred to elsewhere herein, can for example be a pipe, tube, linkage, connecting structure, annular structure, or other structure that permits water (or other fluid) to flow through the structure. Relatedly, the arrowheads shown in FIG. 1 in regard to each of the conduits 132, 134, 136, and 138 are representative of the water present within the respective conduits, as well as indicative of the directions of water flow through those conduits. Similarly, where arrowheads are shown otherwise herein with respect to some other conduits described herein, those arrowheads also should be generally understood as being representative of water, refrigerant, or other fluid(s) present within such conduits, as well as indicative of example directions of flow of such fluid(s) within such conduits (albeit the arrowheads shown in FIG. 1 and elsewhere are intended as examples and are not intended to be exhaustive of all locations at which water or other fluid(s) may be present or flowing). It should be appreciated that, although in the embodiment of FIG. 1 only a single STST 102 is employed, in alternate embodiments in which multiple STSTs are employed, conduits such as those shown in FIG. 1 can be coupled to each of the different STSTs.

More particularly, the heated water flows from the STST 102 to the heating load 126 via the first conduit 132 and returns to the STST from the heating load, after discharging at least some of the heat from the heated water at the heating load, via the second conduit 134. Also, the cool water flows from the STST 102 to the cooling load 128 via the fourth conduit 138 and returns to the STST from the cooling load, after being heated at least to some extent at the cooling load (as the cooling load itself is cooled), via the third conduit 136. The heating load 126 and the cooling load 128 can be, but need not be, considered to be parts of the system 100. That is, although the heating load 126 and cooling load 128 can be considered to form parts of the system 100, one or both of those loads can alternatively be considered to be distinct from the system 100.

Given that heat is delivered to the heating load 126, the heated water delivered via the first conduit 132 is at a higher temperature than when it is returned via the second conduit 134. Likewise, given that heat is removed from the cooling load 128, the cooled water delivered via the fourth conduit 138 is at a lower temperature than when it is returned via the third conduit 136. To accommodate such temperature differentials, and in view of the stratification provided by the STST 102, in the present embodiment the first, second, third, and fourth conduits 132, 134, 136, and 138 are respectively coupled to the STST at four different locations along the height of the STST, namely, first, second, third, and fourth locations 142, 144, 146, and 148, respectively. Each of the different locations 142, 144, 146, and 148 can be understood to be a port, terminal, junction, or position, at which a respective conduit is coupled to or interfaces the STST 102 so as to permit water flow (or, in other embodiments, the flow of other types of fluids) from the interior 104 of the STST into the respective conduit or from the respective conduit into the interior of the STST. It should be appreciated also that, when the term location is used elsewhere herein in a substantially similar context involving the interfacing between a conduit and a STST, such location can again be understood to be a port, terminal, junction, or position at which the conduit is coupled to or interfaces the STST so as to permit water flow (or other types of fluid flow) between the interior of the STST and such conduit.

More particularly as shown, the first location 142 at which the first conduit 132 is coupled to the STST 102 is near the top of the hot section 106, and the second location 144 at which the second conduit 134 is coupled to the STST is near the top of the thermocline section 110 along the first subportion 122. Thus, the heated water that exits the STST 102 via the first conduit 132 is at a higher temperature than when it is returned via the second conduit 134, and the heat loss that occurs at the heating load 126 corresponds to the temperature differential within the STST 102 between first location 142 and second location 144. Additionally as shown, the fourth location 148 at which the fourth conduit 138 is coupled to the STST 102 is near the bottom of the cold section 108, and the third location 146 at which the third conduit 136 is coupled to the STST is near the bottom of the thermocline section. Thus, the cooled (or cold) water that exits the STST 102 via the fourth conduit 138 is at a lower temperature than when it is returned via the third conduit 136, and the heating of that water that occurs at the cooling load 128 (as the cooling load itself is cooled) corresponds to the temperature differential within the STST 102 between fourth location 148 and third location 146.

The system 100 further includes various components by which heat is provided to and/or removed from the STST 102, so that the water within the STST takes on different stratified heat levels and so that heated water can be provided to the heating load 126 and cool water can be provided to the cooling load 128 as discussed above. In particular, the system 100 includes a gas cooler 130, which is a heat exchanger. Additionally, the system 100 also includes an external heat exchanger 140, first and second evaporators 150 and 152, respectively, first and second expansion valves 154 and 156, respectively, and a compressor 158. As will be described in further detail below, the gas cooler 130 in combination with the first and second evaporators 150 and 152, first and second expansion valves 154 and 156, and compressor 158, can be understood to form a heat pump 250 by which heat is communicated to the gas cooler 130. The heat received by the gas cooler 130 due to operation of the heat pump 250 in turn can be transferred to water provided from the thermocline section 110 to the gas cooler 130, so as to thereby generate heated water that is provided back to the hot section 106 of the STST 102 as described in further detail below.

More particularly as shown, a first input port 160 of the gas cooler 130 is coupled by way of a first additional conduit 162 to a first additional location 164 along the STST 102 that is along the thermocline section 110 (but below the second location 144), and a first output port 166 of the gas cooler is coupled by way of a second additional conduit 168 to a second additional location 170 along the STST that is at the top of the STST, at the top of the hot section 106 of the STST. Additionally, an input port 172 of the external heat exchanger 140 is coupled by way of a third additional conduit 174 to a third additional location 176 along the STST 102 that is along the thermocline section 110, generally at the location of the second subsection 124 (below the first additional location 164). Further, an output port 178 of the external heat exchanger 140 is coupled by way of an intermediate conduit 180 to a first input port 182 of the first evaporator 150, and a first output port 184 of the first evaporator is coupled by way of a fourth additional conduit 186 to a fourth additional location 188 along the STST 102 that is proximate the bottom of the cold section 108.

It will be appreciated that the external heat exchanger 140 allows for heat from an auxiliary or external heat source to be added to the water received at the input port 172 from the STST 102 so that the water, when it exits the external heat exchanger at the output port 178, has a higher temperature than when it entered the input port. The external heat exchanger 140 is shown in FIG. 1 to have a further input port 196 and a further output port 198 by which, respectively, a medium (e.g., water or other liquid or fluid, such as a gas) carrying heat to the external heat exchanger from the auxiliary or external heat source can enter that heat exchanger and exit that heat exchanger, respectively. The auxiliary or external heat source can include, for example, any one or more of a variety of ground, air, water, and/or other sources such as, also for example, a waterway, a lake, a river, a geothermal heat source, or a waste heat source.

In the present embodiment, the heat pump 250 includes a first cyclic portion (or pathway) that is referred to herein as a first heat pump 190, as well as a second cyclic portion (or pathway) that is referred to herein as a second heat pump 192. The first heat pump 190 is formed by the combination of the first evaporator 150, the compressor 158, the gas cooler 130, and the first expansion valve 154. As represented by a first arrow 296, the first heat pump 190 particularly operates to cause first heat to flow from the first evaporator 150 to the gas cooler 130. That is, the first heat pump 190 transports the first heat arriving at the first evaporator 150, as provided by the water entering the first input port 182, for receipt by the gas cooler 130. By comparison, the second heat pump 192 is formed by the combination of the second evaporator 152, the compressor 158, the gas cooler 130, and the second expansion valve 156. As represented by a second arrow 298, the second heat pump 192 operates to cause second heat to flow from the second evaporator 152 to the gas cooler 130. Such second heat enters the second heat pump 192 via the second evaporator 152 by way of air that flows into an air inlet 194 (e.g., by which stale air or recirculated air enters that evaporator) and then exits by way of an air outlet 199.

The first and second heat pumps 190 and 192 communicate heat by circulating refrigerant, and operate as transcritical systems in accordance with a transcritical cycle (or transcritical heat pump cycle) and/or perform transcritical refrigeration. In accordance with such operation, the refrigerant within the heat pumps 190 and 192 is in the subcritical state when the refrigerant is located at the first evaporator 150 and the second evaporator 152, and is in the supercritical state when the refrigerant is located at the gas cooler 130. Also in the present embodiment, the refrigerant takes the form of carbon dioxide ($CO_2$), but the present disclosure is also intended to encompass alternate embodiments utilizing any of a variety of other types of refrigerants suitable for operation in accordance with a transcritical cycle (e.g., another liquid or fluid).

More particularly, the circulating of the refrigerant occurs as follows. In the first heat pump 190, the refrigerant circulates by first passing from a second output port 252 of the first evaporator 150 to an input port 254 of the compressor 158 by way of a first further conduit 256, and then from an output port 258 of the compressor 158 to a second input port 260 of the gas cooler 130 by way of a second further conduit 262. Heat is thus communicated from the first evaporator 150 to the gas cooler 130 by this flow of the refrigerant, as represented by the first arrow 296 (which can represent both the flow of the refrigerant as well as the flow of the heat). Within the gas cooler 130, at least some of the heat received by way of the refrigerant entering the second input port 260 is transferred to, and heats, the water proceeding from the first input port 160 to the first output port 166. Due to this heat transfer, the refrigerant received at the second input port 260 is cooled. Subsequently, the refrigerant (now cooled) exits the gas cooler 130 by way of a second output port 264 and proceeds to an input port 266 of the first expansion valve 154 by way of a third further conduit 268. Further, the refrigerant then proceeds out of an output port 270 of the first expansion valve 154 back to a second input port 272 of the first evaporator 150 by way of a fourth further conduit 274, such the circulation of the refrigerant by the first pump 190 can be repeated.

In the second heat pump 192, the refrigerant circulates by first passing from an output port 276 of the second evaporator 152 to the input port 254 of the compressor 158 by way of a fifth further conduit 278, and then from the output port 258 of the compressor 158 to the second input port 260 of the gas cooler 130 by way of the second further conduit 262. Heat is thus communicated from the second evaporator 152 to the gas cooler 130 by this flow of the refrigerant, as represented by the second arrow 298 (which can represent both the flow of the refrigerant as well as the flow of the heat). Within the gas cooler 130, at least some of the heat received by way of the refrigerant entering the second input port 260 is transferred to, and heats, the water proceeding from the first input port 160 to the first output port 166. Due to this heat transfer, the refrigerant received at the second input port 260 is cooled. Subsequently, the refrigerant (now cooled) exits the gas cooler 130 by way of the second output port 264 and proceeds to an input port 280 of the second expansion valve 156 by way of a sixth further conduit 282. Further, the refrigerant then proceeds out of an output port 284 of the second expansion valve 156 back an input port 286 of the second evaporator 152 by way of a seventh further conduit 288, such that circulation of the refrigerant by the second heat pump 192 can be repeated.

It will be appreciated that the first heat pump 190 and the second heat pump 192 each share in common not only the gas cooler 130 but also the compressor 158 as well as the second further conduit 262. Also, the third further conduit 268 and sixth further conduit 282 can be jointly formed as a Y-shaped conduit having a single input portion coupled to the gas cooler 130 that branches into two output portions that are respectively coupled to the first and second expansion valves 154 and 156, respectively. Additionally, the first further conduit 256 and fifth further conduit 278 also can be jointly formed as a Y-shaped conduit having two input portions that are respectively coupled to the first and second evaporators 150 and 152, respectively, and that merge into an output portion that is coupled to the compressor 158. Given this to be the case, the first and second heat pumps 190 and 192 can be considered to constitute two heat pumps that are coupled in parallel. Further, it should be appreciated that portions of the refrigerant that flow through the first heat pump 190 (e.g., through the first evaporator 150) at one given time can flow through the second heat pump 192 (e.g., through the second evaporator 152) at another given time, and vice-versa. Therefore, given the coupling of the first and second heat pumps 190 and 192 and the sharing (or commingling) of refrigerant used by those pumps, the first and second heat pumps also can be considered to form a single combination heat pump, namely, the heat pump 250.

A first method or process of operation encompassed by the present disclosure is evident from the schematic diagram of the system 100 of FIG. 1. The first method can be understood to include several subprocesses. In accordance with a first subprocess of the first method, heat communicated to the gas cooler 130 is in turn communicated, indirectly, to the heating load 126 and to the cooling load 128 through the STST 102. This first subprocess can be understood to begin with transferring of heat within the gas cooler 130. That is, due to indirect contact within the gas cooler 130, heat is communicated from the refrigerant to the water received via the first additional conduit 162 and, correspondingly, the water received at the gas cooler by way of the first additional conduit 162 cools the refrigerant flowing within the first heat pump 190 and the second heat pump 192. As a consequence of the heat exchange within the gas cooler 130, the temperature of the water received via the first additional conduit 162 is increased, and that heated (hot) water is then fed back from the gas cooler 130 through the top of the STST 102 by way of the second additional conduit 168. Upon being returned to the STST 102 via the second additional conduit 168, the hot water is then stored within the STST 102.

The first subprocess next continues with heating of the heating load 126 by way of the stored hot water. That is, the stored hot water comes out of (or exits proximate to) the top of the hot section 106 of the STST 102 at the first location 142 via the first conduit 132, and is utilized to heat the heating load 126. After at least some of the heat is transferred to the heating load 126, the water exiting the heating load by way of the second conduit 134 (the heating load return) returns cooler to the second location 144, which is at an upper height in the thermocline section 110 compared to the level at which the water exited the hot section via the first conduit 132.

The first method also includes a second subprocess in which heat is communicated away from the first evaporator 150 by the first heat pump 190 and correspondingly, at least indirectly, heat is communicated away from the cooling load 128. In this regard, this second subprocess first includes transferring heat within the first evaporator 150 to the refrigerant of the first heat pump 190. That is, the second subprocess can be understood to begin with the extraction of heat via the first evaporator 150 from the water received, at least indirectly from the thermocline section 110 of STST 102, at the first input port 182 by way of the intermediate conduit 180. As a consequence of this extraction of heat at the first evaporator 150, the refrigerant of the first heat pump 190 is heated when it exits the output port 252 of the first evaporator by comparison to when it entered the input port 272. Correspondingly, the water that exits the first output port 184 of the first evaporator 150 and proceeds through the fourth additional conduit 186 has a lower temperature than when that water entered the first input port 182 of the first evaporator.

Accordingly, the output of water from the first evaporator 150 makes it possible to supply the cold section 108 (the bottom) of the STST 102 with cooler (cold) water, even though that water earlier came from the thermocline section 110 of the STST 102. This cooler water is then provided to the cooling load 128 via the fourth conduit 138 coming out of the bottom of the STST 102 at the fourth location 148. Further, after passing through the cooling load 128, the water returns to the STST 102 (as the cooling load return) hotter, at the third location 146 that is at low level in the thermocline section 110, above the cold section 108 and above the fourth location 148 within that cold section.

Further in relation to the second subprocess, in some embodiments encompassed herein the water received at the input port 182 of the first evaporator 150 can be provided directly from the thermocline section 110 of the STST 102 via a conduit. Nevertheless, in the embodiment of FIG. 1, the water received at input port 182 arrives directly from the external heat exchanger 140. Given such an arrangement, the second subprocess should also be considered to include an additional step of extracting heat from an auxiliary heat source at the external heat exchanger 140, so as to heat the water received at the input port 172 of that heat exchanger from the thermocline section 110. The external heat exchanger 140 particularly can operate to recover thermal energy from an external auxiliary heat source, for example from the ground or a water source. Upon such heat extraction occurring, then the second subprocess further includes communicating the heated water from the output port 178 of the external heat exchanger 140 for receipt by the input port 182 of the first evaporator 150.

In addition to the aforementioned first and second subprocesses, the first method illustrated by FIG. 1 includes third and fourth subprocesses related to operations of the first heat pump 190 and the second heat pump 192, respectively. The third subprocess can be understood to include the aforementioned extraction of heat by the first evaporator 150 (as discussed above in regard to the second subprocess) so that the refrigerant at the subcritical state is heated and evaporates prior to exiting the first output port 252. Following that heat extraction, the refrigerant is communicated to the input port 254 of the compressor 158, where that refrigerant is compressed. Next, the compressed refrigerant exits the compressor 158 at the output port 258 and proceeds to the input port 260 of the gas cooler. At the gas cooler, heat is (as discussed above in regard to the first subprocess) transferred to the water entering at the input port 160 and exiting at the output port 166, such that the refrigerant is cooled when it exits the gas cooler at the output port 264. Further, the cooled refrigerant flows to enter the input port 266 of the first expansion valve 154, at which expansion occurs. Finally, the cooled refrigerant (after expansion) flows from the output port 270 of the expansion valve via the conduit 274 to the input port 272 of the first evaporator 150, at which heat extraction can again occur.

By comparison, the fourth subprocess involves the extraction of heat by the second evaporator 152. That is, the second evaporator 152 performs direct air expansion to recover, for example, heat from the exhaust air from a building or process before being exhausted to the outside. This recovered heat is transferred, by way of the second evaporator 152, to refrigerant at the subcritical state received at the input port 286 of the second evaporator, so that the refrigerant is heated when it exits the second evaporator at the output port 276. Following that heat extraction, the refrigerant is communicated to the input port 254 of the compressor 158, where that refrigerant is compressed. Next, the compressed refrigerant exits the compressor 158 at the output port 258 and proceeds to the input port 260 of the gas cooler. At the gas cooler, heat is (as discussed above in regard to the first subprocess) transferred to the water entering at the input port 160 and exiting at the output port 166, such that the refrigerant is cooled when it exits the gas cooler at the output port 264. Further, the cooled refrigerant flows to enter the input port 280 of the second expansion valve 156, at which expansion occurs. Finally, the cooled refrigerant (after expansion) flows from the output port 284 of the expansion valve via the conduit 288 to the input port 286 of the second evaporator 152, at which heat extraction can again occur.

It should be appreciated that, due to operation of the first system 100 in accordance with the first method of FIG. 1, there is a supply of hot water and cold water at different temperature levels in the STST 102—namely, the supplying of hot water at the top of the STST at the second additional location 170 and the supplying of cold water at the bottom of the STST at the fourth additional location 188. Such supplying of the hot water and cold water at different temperature levels in the STST 102 at the second and fourth additional locations 170 and 188 generates a stratification of water at different temperatures within the STST 102 between the top and bottom ends thereof. This in turn makes it possible to supply the gas cooler 130 with water that is at a lower temperature (via the first additional conduit 162) and to supply the evaporator 150 with water that is at a higher temperature (via the third additional conduit 174 and intermediate conduit 180) than would be the case if the supply of water to the gas cooler and the supply of water to the evaporator were provided directly from the return conduits of from the heating load 126 and cooling load 128. The first method also makes it possible to condition the temperature of the heat transfer fluid (e.g., water) entering the gas cooler 130 when the heat pump 250 is operating in a closed loop and paired with the STST 102.

The first method represented by FIG. 1 is only one example method of operation encompassed herein. Further, it should be understood that, depending upon the embodiment or circumstance, the first, second, third, and fourth subprocesses encompassed by the first method described above can be performed simultaneously with one another, or alternatively in other manners. For example, in some embodiments or circumstances, one or more of the first, second, third, and fourth subprocesses can be performed sequentially or in an alternating manner. Further for example, in some circumstances, the third subprocess (involving operation of the first heat pump 190) can be performed for a period of time when the fourth subprocess (involving operation of the second heat pump 192) is not being performed, and subsequently both subprocesses can be performed simultaneously.

The present disclosure is intended to encompass numerous additional embodiments in addition to that which is shown and described in regard to FIG. 1. In at least one such additional embodiment, a STST portion 299 of the system 100 shown in FIG. 1 is replaced with a modified STST portion 200 shown in FIG. 2 so as to form a modified version of the system (or second system). By virtue of the implementation of the modified STST portion 200, control of the inlet water temperatures of the gas cooler 130 and the first evaporator 150 can be achieved by way of mixing valves. As shown in FIG. 1, the STST portion 299 includes the STST 102 in combination with the heating load 126 and cooling load 126, along with the associated first, second, third, and fourth conduits 132, 134, 136, and 138. The STST portion 299 can also be understood to include respective portions of each of the first, second, third, and fourth additional conduits 162, 168, 174, and 186 leading away from the STST 102. That is, the STST portion 299 includes portions of each of those respective conduits 162, 168, 174, and 186 that are coupled to the STST 102, but does not include remaining portions of those conduits by which those respective conduits are coupled to the gas cooler 130, the external heat exchanger 140, and the first evaporator 150.

By comparison to the first method, the modified STST portion 200 again includes an STST 201 that again includes each of the hot section 106, cold section 108, and thermocline section 110. Also, the modified STST portion 200 again includes the heating load 126 and the cooling load 128 as well as the first, second, third, and fourth conduits 132, 134, 136, 138 that couple the STST 201 to those loads (as described above, although the heating and cooling loads can be considered to form part of the same system as the STST 201 and the conduits 132, 134, 136, and 138, one or both of those loads alternatively can be considered distinct from that system). Further, the first, second, third, and fourth conduits 132, 134, 136, and 138 respectively are coupled to the STST 201 again at the first, second, third and fourth locations 142, 144, 146, and 148, respectively. Also, the modified STST portion 200 includes the same (or substantially the same) portions of the first, second, third, and fourth additional conduits 162, 168, 174, and 186 as are included in the STST portion 299, and particularly the second additional conduit 168 and the fourth additional conduit 186 are respectively coupled to the second and fourth additional locations 170 and 188 on the STST 201, respectively, as is the case with the STST portion 299 with respect to the STST 102.

In contrast to the STST portion 299, however, the portions of the first additional conduit 162 and third additional conduit 174 that are included in the modified STST portion 200 are not respectively coupled to the thermocline section 110 at the first additional location 164 and third additional location 176. Rather, the modified STST portion 200 includes a first mixing valve 202 and a second mixing valve 204, the portion of the first additional conduit 162 included by the modified STST portion 200 is coupled to a first port 206 of the first mixing valve 202 and the portion of the third additional conduit 174 included by the modified STST portion is coupled to a first port 208 of the second mixing valve 204. Additionally, each of the first and second mixing valves 202 and 204 respectively in turn is coupled to two different respective locations along the STST 201 rather than merely one respective location as with respect to the STST portion 299.

More particularly, the first mixing valve 202 includes a second port 212 that is coupled by way of a fifth additional conduit 214 to a fifth additional location 216 along the thermocline section 110, and also a third port 218 that is coupled by way of a sixth additional conduit 220 to a sixth additional location 222 along the thermocline section. Also, the second mixing valve 204 includes a second port 232 that is coupled by way of a seventh additional conduit 234 to a seventh additional location 236 along the thermocline section 110, and also a third port 238 that is coupled by way of an eighth additional conduit 240 to an eighth additional location 242 along (near the bottom of) the thermocline section.

Figure 2:
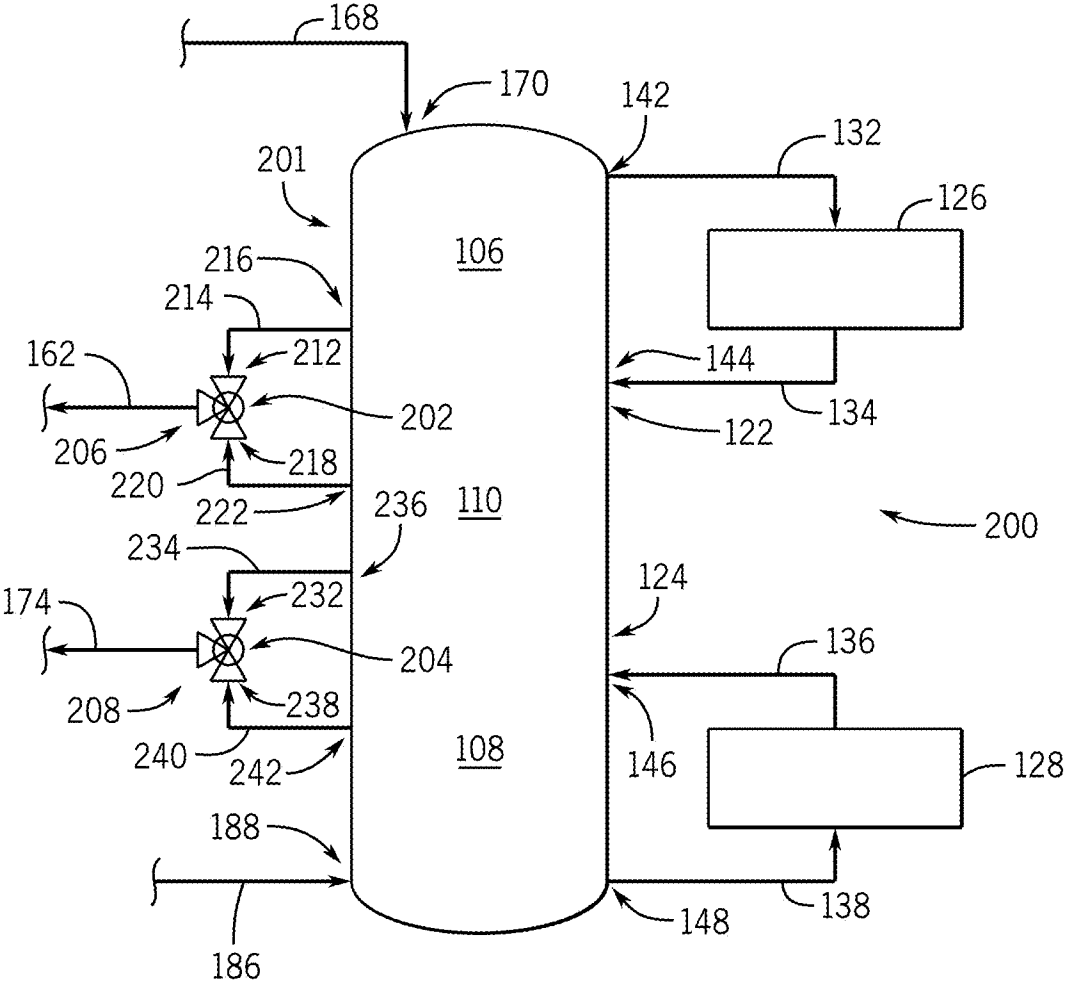
FIG. 2 is a schematic drawing showing an alternate embodiment of a portion of the system of FIG. 1, which is intended to illustrate aspects of a second system and corresponding second method for heating and/or cooling by way of water temperature conditioning, in which a STST is employed, in accordance with a second example embodiment.

As shown in FIG. 2, in the present example embodiment, the fifth additional location 216 is at the upper end of the thermocline section 110, in the first subportion 122, but the sixth additional location 222 is located in the mid-region of the thermocline section. Also, the eighth additional location 242 is at the bottom of the thermocline section 110, but the seventh additional location 236 is located in the mid-region of the thermocline section, below the sixth additional location 222. Given this arrangement, based upon the actuation of the first mixing valve 202, the water that flows through the first additional conduit 162 can include either water obtained from the fifth additional location 216 or water obtained from the sixth additional location 222, or a combination of water from both of those locations. Likewise, based upon the actuation of the second mixing valve 204, the water that flows through the conduit 174 can include either water obtained from the seventh additional location 236 or water obtained from the eighth additional location 242, or a combination of water from both of those locations. The actuations/settings of each of the first mixing valve 202 and the second mixing valve 204 can be determined in accordance with one or more control signals provided thereto from a controller (not shown).

Further, given that the fifth additional location 216 is at a higher level than the sixth additional location 222, the temperature of the water flowing through the first additional conduit 162 will depend upon the extent to which that water is arriving from the fifth additional location 216 or from the sixth additional location 222. That is, the temperature of the water flowing through the conduit 162 will have the temperature of the water at the fifth additional location 216 if the first mixing valve 202 is actuated so that only water from that fifth additional location is directed to the conduit 162, or will have the temperature of the water at the sixth additional location 222 if the first mixing valve 202 is actuated so that only water from that sixth additional location is directed to that conduit. Additionally, the temperature of the water flowing through the conduit 162 can also be any temperature in between the temperatures of the water at the fifth and sixth additional locations 216 and 222 depending upon the relative proportions of the water in the conduit 162 that are provided from those respective locations 216 and 222 based upon the actuation/setting of the first mixing valve 202.

Also, given that the seventh additional location 236 is at a higher level than the eighth additional location 242, the temperature of the water flowing through the conduit 174 will depend upon the extent to which that water is arriving from the seventh additional location 236 or from the eighth additional location 242. That is, the temperature of the water flowing through the conduit 174 will have the temperature of the water at the seventh additional location 236 if the second mixing valve 204 is actuated so that only water from that seventh additional location is directed to the conduit 174, or will have the temperature of the water at the eighth additional location 242 if the second mixing valve 204 is actuated so that only water from that eighth additional location is directed to that conduit. Additionally, the temperature of the water flowing through the conduit 174 can also be any temperature in between the temperatures of the water at the seventh and eighth additional locations 236 and 242 depending upon the relative proportions of the water in the conduit 174 that are provided from those respective locations 236 and 242 based upon the actuation/setting of the second mixing valve 204.

Assuming that the system 100 of FIG. 1 is modified to employ the modified STST portion 200 in place of the STST portion 299, it should be appreciated that the first method can additionally be modified to include one or both of first and second further subprocesses in addition to the subprocesses described above. With such further subprocesses, the modified first method can be considered a second method of operation. According to the first further subprocess, given the features of the modified STST portion 200 and particularly the first mixing valve 202, it is possible to impose any of a variety of particular temperatures of water at the input port (inlet) 160 of the gas cooler, due to the internal stratification within the STST 201. During this first further subprocess, the actuation/setting of the first mixing valve 202 is controlled to set or adjust the relative contributions to the water within the first additional conduit 162 from one or both of the fifth additional location 216 and the second additional location 222. Because these two locations (outlets) 216 and 222 along the STST 201 are at different heights, depending upon the actuation/setting of the first mixing valve 202, the water provided to the first input port 160 of the gas cooler 130 can be varied (or fine tuned) to have any of a variety of colder or hotter temperature at or in between the temperatures of the water at those two locations. The flow rate of each of the streams provided from each of the fifth and sixth additional locations 216 and 222 can be adjusted based on a setpoint and/or a temperature measured at the first input port 160 of the gas cooler.

According to the second further subprocess, given the features of the modified STST portion 200 and particularly the second mixing valve 204, it is possible to impose any of a variety of particular temperatures of water at the input port (inlet) 182 of the first evaporator 150 due to the internal stratification within the STST 201. During this first further subprocess, the actuation/setting of the second mixing valve 204 is controlled to set or adjust (or fine tune) the relative contributions to the water within the third conduit 174 from one or both of the seventh additional location 236 and the eighth additional location 242. Because these two locations (outlets) 236 and 242 along the STST 201 are at different heights, depending upon the actuation/setting of the second mixing valve 204, the water provided to the input port 182 of the first evaporator 150 can be controlled to have any of a variety of colder or hotter temperatures. More particularly, if the external heat exchanger 140 is not operating to add heat (or is not present), then the water provided to the input port 182 of the first evaporator 150 can be controlled to have any of a variety of colder or hotter temperatures at or in between the temperatures of the water at seventh and eighth additional locations 236 and 242. The flow rate of each of the streams provided from each of the seventh and eighth additional locations 236 and 242 can be adjusted based on a setpoint and/or a temperature measured at the input port 182 of the first evaporator 150.

Although the above discussion presumes that the external heat exchanger 140 in some circumstances is not operating (or may not be present) to add heat to the water provided to the first evaporator 150, nevertheless it is envisioned that in some embodiments (such as that of FIG. 1) and operational circumstances the external heat exchanger 140 will contribute heat to the water provided to the first evaporator. In such embodiments or circumstances, controlling the actuation/setting of the mixing valve 204 will directly control the temperature of the water at the input port 172 of the external heat exchanger 140, and the temperature of the water at the input port 182 of the first evaporator 150 will depend not only upon that water temperature at the input port 172 but also upon the temperature change arising due to the introduction of heat from the external heat exchanger 140. When the external heat exchanger 140 is present and operating to contribute heat to the water provided to the input port 182, control over the actuation/setting of the mixing valve 204 can cause the temperature of the water provided at the input port 182 to have any of a variety of colder or hotter temperatures at or in between (i) the sum of water temperature at the seventh additional location 236 plus the temperature increase from the external heat exchanger 140, and (ii) the sum of the water temperature at the eighth additional location 242 plus the temperature increase from the external heat exchanger.

Figure 3:
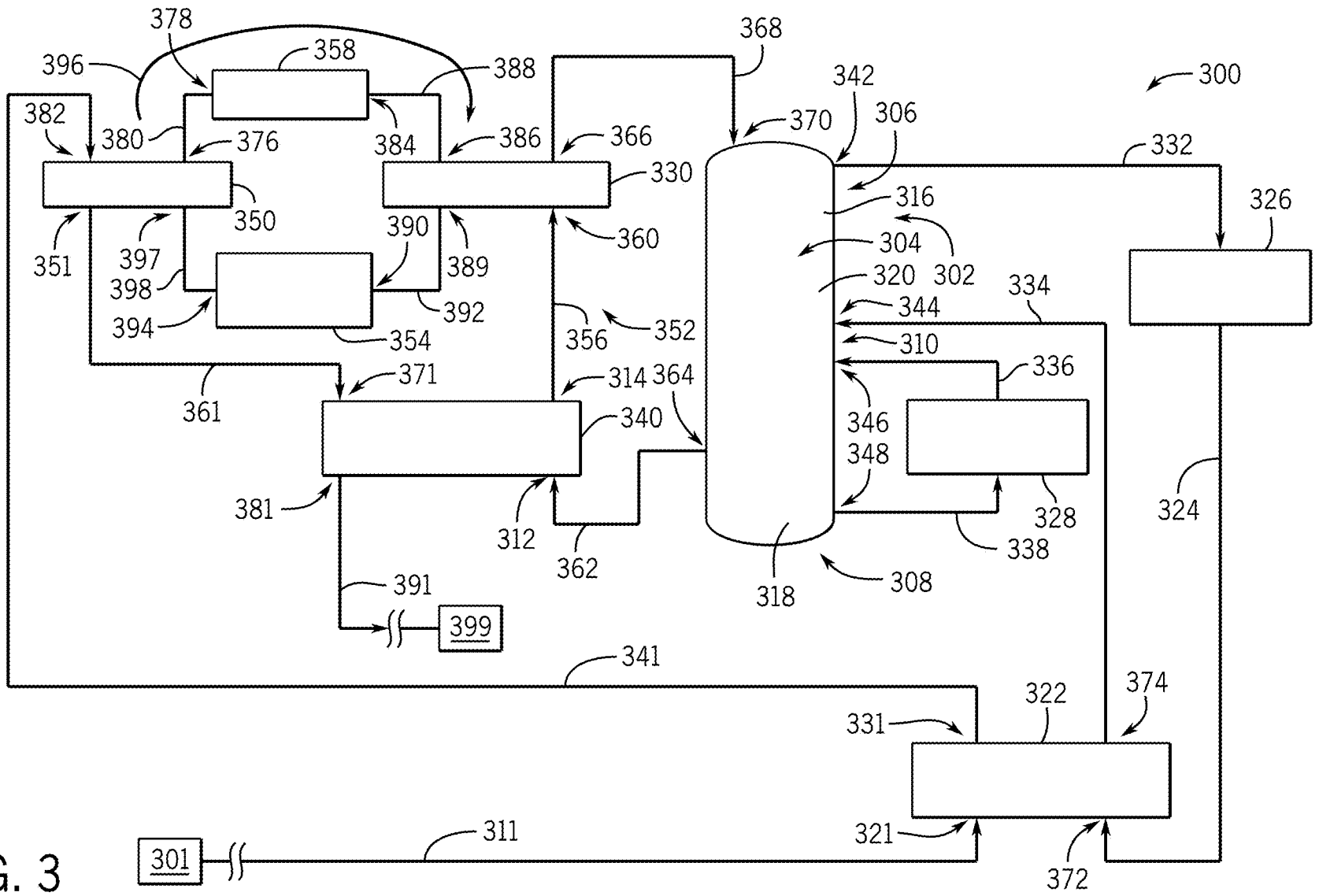
FIG. 3 is a schematic drawing showing a third system and corresponding third method for heating and/or cooling, in which water temperature conditioning particularly occurs at (or with respect to water entering) an evaporator inlet to prevent ice formation when a heat source is external, in accordance with a third example embodiment.

Turning now to FIG. 3, an additional schematic drawing is provided to illustrate an additional, third system 300 that is configured for water temperature conditioning, in accordance with an additional example embodiment encompass herein. In this embodiment, the third system 300 particularly operates by way of water temperature conditioning at an input port 382 of an evaporator 350, which serves to reduce or prevent ice formation when a heat source for the third system is external of the system. As shown, the third system 300 again includes a stratified thermal storage tank (STST) 302, which again may be pressurized or not pressurized depending upon the embodiment. Similar to the STST 102 of FIG. 1, the STST 302 defines an interior chamber 304 that can be considered to have each of a hot section 306, a cold section 308, and a thermocline section 310 positioned between the hot and cold sections. The exact boundaries of the hot section 306 relative to the thermocline section 310, and between the thermocline section and the cold section 308, are not necessarily exact and may be defined somewhat arbitrarily based upon temperature variation in the STST 302. In the present embodiment, the hot section 306 is vertically above the thermocline section 310, which in turn is above the cold section 308, although this arrangement may vary.

As with the STST 102, the STST 302 may be considered or referred to as "stratified" insofar as the water contained within the storage tank has different temperatures based upon the position or level of the water within the storage tank. In general, a first portion 316 of the water that is within the hot section 306 has a higher temperature than a second portion 318 of the water that is within the cold section 308, and a third portion 320 of the water that is within the thermocline section 310 generally is of a temperature that is in between the temperatures of the first and second portions of the water. The third portion 320 of the water that is within the thermocline section 310 particularly is a stratified part of the water, which separates the first portion 316 of the water within the hot section 306 (the hotter region) from the second portion 318 of the water within the cold section 308 (the cold region), and in which temperature(s) decreases rapidly with decreases of the height in the tank. Additionally, although the present discussion particularly identifies the first, second, and third portions 316, 318, and 320 of water, it should be further recognized that further stratifications or gradations of portions of water within the interior chamber 304 also occur.

Further as shown in FIG. 3, the STST 302 is connected and configured to supply heated water to a heating load 326 as well as to supply cool (or cooled or cold) water to a cooling load 328. As shown, the heating load 326 is coupled to the STST 302 by way of a first conduit 332. Additionally, the STST 302 is also coupled to the heating load 326 indirectly by way of a first external heat exchanger 322. In this regard, a second conduit 334 links the STST 302 to the first external heat exchanger 322, and additionally a first intermediate conduit 324 links the external heat exchanger with the heating load 326. Further, the cooling load 328 is coupled to the STST by way of a third conduit 336 and a fourth conduit 338. More particularly, the heated water flows from the STST 302 to the heating load 326 via the first conduit 332, at which at least some of the heat from the heated water is discharged. The heated water, after passing through the heating load 326, next proceeds via the first intermediate conduit 324 to a first input port 372 of the first external heat exchanger 322, at which additional heat is discharged. The heated (now cooler) water then exits the first external heat exchanger 322 at a first output port 374 thereof, and returns to the STST 302 from the first external heat exchanger 322 by way of the second conduit 334.

Also, the cool water flows from the STST 302 to the cooling load 328 via the fourth conduit 338 and returns to the STST from the cooling load, after being heated at least to some extent at the cooling load (as heat is extracted from the cooling load), via the third conduit 336. The heating load 326 and the cooling load 328 can be, but need not be, considered to be parts of the third system 300. That is, although the heating load 326 and cooling load 328 can be considered to form parts of the system 300, one or both of those loads can alternatively be considered to be distinct from the system 300.

Given that heat is delivered to the heating load 326 and also to the first external heat exchanger 322, the heated water delivered via the first conduit 332 is at a higher temperature than when it is returned via the second conduit 334. Likewise, given that heat is removed from the cooling load 328, the cooled water delivered via the fourth conduit 338 is at a lower temperature than when it is returned via the third conduit 336. To accommodate such temperature differentials, and in view of the stratification provided by the STST 302, in the present embodiment the first, second, third, and fourth conduits 332, 334, 336, and 338 are respectively coupled to the STST at four different locations along the height of the STST, namely, first, second, third, and fourth locations 342, 344, 346, and 348, respectively.

More particularly as shown, the first location 342 at which the first conduit 332 is coupled to the STST 102 is near the top of the hot section 306, and the second location 344 at which the second conduit 334 is coupled to the STST is near the top of the thermocline section 310. Thus, the heated water that exits the STST 302 via the first conduit 332 is at a higher temperature than when it is returned via the second conduit 334, and the heat loss that occurs at the heating load 326 and first external heat exchanger 322 corresponds to the temperature differential within the STST 302 between first location 342 and second location 344.

Additionally as shown, the fourth location 348 at which the fourth conduit 338 is coupled to the STST 302 is near the bottom of the cold section 308, and the third location 346 at which the third conduit 336 is coupled to the STST is near the bottom of the thermocline section, above the cold section. Thus, the cooled (or cold) water that exits the STST 302 via the fourth conduit 338 is at a lower temperature than when it is returned via the third conduit 336, and the heating of that water that occurs at the cooling load 328 (as the cooling load itself is cooled) corresponds to the temperature differential within the STST 302 between fourth location 348 and third location 346.

The third system 300 further includes various components by which heat is provided to and/or removed from the STST 302, so that the water within the STST takes on different stratified heat levels and so that heated water can be provided to the heating load 326 and cool water can be provided to the cooling load 328 as discussed above. In addition to the first external heat exchanger 322 and evaporator 350 already mentioned above, the third system 300 also includes a gas cooler 330 (which again is a form of heat exchanger) as well as each of a second external heat exchanger 340, an expansion valve 354, and a compressor 358. As will be described in further detail, the gas cooler 330 in combination with the evaporator 350, expansion valve 354, and compressor 358, can be understood to form a heat pump 352 by which heat is communicated to the gas cooler 330. The heat received by the gas cooler 330 due to operation of the heat pump 352 in turn can be transferred to water provided indirectly (via the second external heat exchanger 340) from the cold section 308 of the STST 302 to the gas cooler 330, so as to thereby generate heated water that is provided back to the hot section 306 of the STST. Also, in the present embodiment, the heated water provided back to the hot section 306 of the STST not only is heated by way of the heat pump 352, but also is heated due to operation of the first and second external heat exchangers 322 and 340.

More particularly as shown, a first input port 312 of the second external heat exchanger 340 is coupled by way of a first additional conduit 362 to a first additional location 364 along or within (e.g., at or near the bottom of) the thermocline section 310. Additionally, a first output port 314 of the second external heat exchanger 340 is coupled by way of a second intermediate conduit 356 to a first input port 360 of the gas cooler 330, and a first output port 366 of the gas cooler is coupled by way of a second additional conduit 368 to a second additional location 370 along the STST that is at the top of the STST, at the top of the hot section 306 of the STST. Although the first additional location 364 in the present embodiment is along the thermocline section 310, in an alternate embodiment the first additional location can be at a lower level along the STST, such as at or near the bottom of the cold section 308.

Further, in the present embodiment, the heat pump 352 includes a cyclic portion (or pathway) that is formed by the combination of the evaporator 350, the compressor 358, the gas cooler 330, and the expansion valve 354. As represented by an arrow 396, the heat pump 352 particularly operates to cause first heat to flow from the evaporator 350 to the gas cooler 330. That is, the heat pump 352 transports the heat arriving at the evaporator 350, as provided by the water entering the first input port 382, for receipt by the gas cooler 330. As with the first and second heat pumps 190 and 192 of FIG. 1, the heat pump 352 transfers heat by circulating refrigerant, and operates as a transcritical system in accordance with a transcritical cycle (or transcritical heat pump cycle) and/or performs transcritical refrigeration. In accordance with such operation, the refrigerant within the heat pump 352 is in the subcritical state when the refrigerant is located at the evaporator 350, and is in the supercritical state when the refrigerant is located at the gas cooler 330. Also in the present embodiment, the refrigerant takes the form of carbon dioxide ($CO_2$), but the present disclosure is also intended to encompass alternate embodiments utilizing any of a variety of other types of refrigerants suitable for operation in accordance with a transcritical cycle (e.g., another liquid or fluid).

More particularly, the heat pump 352 communicates heat by circulating refrigerant (e.g., $CO_2$ or another refrigerant) as follows. First, the refrigerant circulates by passing from a second output port 376 of the evaporator 350 to an input port 378 of the compressor 358 by way of a first further conduit 380, and then from an output port 384 of the compressor 358 to a second input port 386 of the gas cooler 330 by way of a second further conduit 388. Heat is thus communicated from the evaporator 350 to the gas cooler 330 by this flow of the refrigerant, as represented by the first arrow 396 (which can represent both the flow of the refrigerant as well as the flow of the heat). Within the gas cooler 330, at least some of the heat received by way of the refrigerant entering the second input port 386 is transferred to, and heats, the water proceeding from the first input port 360 to the first output port 366. Due to this heat transfer, the refrigerant exiting a second output port 389 is cooled. Subsequently, the refrigerant (now cooled) exiting the gas cooler 330 by way of the second output port 389 proceeds to an input port 390 of the first expansion valve 354 by way of a third further conduit 392. Further, the refrigerant then proceeds out of an output port 394 of the first expansion valve 354 back to a second input port 397 of the first evaporator by way of a fourth further conduit 398, such the circulation of the refrigerant by the heat pump 352 is repeated.

In the present embodiment, the heat arriving at the evaporator 350, as provided by the water entering the first input port 382, comes from multiple sources. First, in the present embodiment, the third system 300 is directly connected to an external heat source 301 in an open-loop manner. The external heat source 301 can include, for example, any one or more of a variety of ground, air, water, and/or other sources such as, also for example, a waterway, a lake, a river, a geothermal heat source, or a waste heat source. Further as shown, a source conduit 311 (shown with break lines) links the external heat source 301 to a second input port 321 of the first external heat exchanger 322 for the communication of externally-heated water from that external heat source to the first external heat exchanger. As already discussed above, the first external heat exchanger 322 is additionally coupled indirectly to the hot section 306 of the STST 302, by way of the conduits 372 and 324 and the heating load 326. Although at least some of the heat communicated by the heated water from the STST 302 to the heating load 326 is absorbed by the heating load, some of the heat typically is not absorbed by the heating load but rather is communicated, along with the water exiting the heating load, to the first input port 372 of the first external heat exchanger 322. Given this arrangement, additional heat is communicated within the first external heat exchanger 322 from the heated water received at the first input port 372 from the heating load 326 to the heated water received at the second input port 321 from the external heat source 301.

Thus, the heated water that exits a second output port 331 of the first external heat exchanger 322 includes heat provided both from the external heat source 301 and also due to operation of the first external heat exchanger (arriving indirectly from the heated water communicated to the heating load 326 from the hot section 306 of the STST 302). That heated water exiting the second output port 331 in turn is communicated, via a third intermediate conduit 341, to the first input port 382 of the evaporator 350. The evaporator 350 in turn extracts at least some of that heat for delivery by the heat pump 352 to the gas cooler 330 as indicated by the arrow 396. Further, although the evaporator 350 extracts at least some of the heat for delivery by the heat pump 352, typically some of the heat received with the heated water at the first input port 382 is not extracted by the evaporator but rather exits the evaporator along with that water by way of a second output port 351 of the evaporator.

In the present embodiment, the water exiting the second output port 351 of the evaporator 350 is communicated via a fourth intermediate conduit 361 to a second input port 371 of the second external heat exchanger 340. Upon receiving this water at the second input port 371, the second external heat exchanger 340 is able to transfer at least some residual heat contained in the cold water received at the first input port 312 from the STST 302 away from that cold water and to the water received at the second input port 371. Thus, the water communicated from the first output port 314 of the external heat exchanger 340 via the second intermediate conduit 356 to the gas cooler 330 is somewhat cooled as it reaches (or is pre-cooled before reaching) the first input port 360 of the gas cooler 330 for heating at that gas cooler. Additionally, due to the transfer of heat within the second external heat exchanger 340, the water received at the second input port 371 is heated somewhat as that water passes between the second input port 371 and a second output port 381 of the second external heat exchanger. After passing out of the second output port 381 of the second external heat exchanger 340, that water then is transported by a source return conduit 391 (shown with break lines) for receipt by an external heat source 399. The external heat source 399 can be, but need not be, the same external heat source as the external heat source 301.

A third method or process of operation encompassed by the present disclosure is evident from the schematic diagram of the additional (third) system 300 of FIG. 3. As with the first method corresponding to the system 100 of FIG. 1, the third method can be understood to include several subprocesses. In accordance with a first subprocess of the third method, hot water is provided to the hot section 306 of the STST 302 and communicated, indirectly, to the heating load 326. This first subprocess can be understood to begin with the transferring of heat by the second external heat exchanger 340 to the cold water received from the cold section 308 of the STST 302, by way of the first additional conduit 362, at the first input port 312 of that heat exchanger (or, in an alternate embodiment in which the first additional location 364 is at a higher level along the STST 302 such as within the thermocline section 310, this first subprocess can include transferring heat by the second external heat exchanger to that water received from the thermocline section of the STST).

Next, that water (now heated to some extent) flows out of the first output port 314 of the second external heat exchanger 340, by way of the second intermediate conduit 356, to the first input port 360 of the gas cooler 330. Within the gas cooler 330, additional heat is transferred from the refrigerant entering the second input port 386 of the gas cooler 330 to the water entering the first input port 360 of the gas cooler. After passing through the gas cooler 330 and experiencing additional heating, the heated (hot) water then passes out of the second output port 366 of the gas cooler and is fed back through the top of the STST 302 by way of the second additional conduit 368. Upon being returned to the STST 302 via the second additional conduit 368, the hot water is then stored within the STST 302.

The first subprocess next continues with heating of the heating load 326 by way of the stored hot water. That is, the stored hot water comes out of (or exits proximate to) the top of the hot section 306 of the STST 302 at the first location 342 via the first conduit 332, and is utilized to heat the heating load 326. After at least some of the heat is transferred to the heating load 326, the water exits the heating load by way of the first intermediate conduit 324. In contrast to the first subprocess of the first method of FIG. 1, the water exiting the heating load 326 does not proceed directly back to the STST 302, but rather proceeds to the first input port 372 of the first external heat exchanger 322, which extracts heat from that water. After passing through the first external heat exchanger 322, the water passes out of the first output port 374 thereof and through the second conduit 334 (the heating load return). Due to the transfers of heat that occur at the heating load 326 and also the first external heat exchanger 322, the water returns cooler to the STST 302 at the second location 344 along the thermocline section 310, by comparison with the temperature at which the water exited the hot section 306 via the first conduit 332. Accordingly, cold water can continue to be provided from the thermocline section 310 of the STST 302 to the first input port 312 of the second external heat exchanger 340 and the first subprocess can continue to occur in an ongoing manner.

In addition to the above operations, the first subprocess of the third method can also be considered to include cooling of the cooling load 328. That is, during the first subprocess, cold water also flows from the fourth location 348 along the bottom of the cold section 308 of the STST 302 to the cooling load 328, at which heat is extracted. Subsequently, that water (now warmed to some extent) returns to the third location 346 near the bottom of the thermocline section 310.

In addition to the first subprocess, the third method also includes a second subprocess in which heat is communicated away from the evaporator 350 by the heat pump 352. In this regard, this second subprocess first includes transferring heat within the evaporator 350 to the refrigerant of the heat pump 352. That is, the second subprocess can be understood to begin with the extraction of heat via the evaporator 350 from the water received at the first input port 382. As a consequence of this extraction of heat at the first evaporator 350, the refrigerant of the heat pump 352 is heated when it exits the output port 376 of the evaporator by comparison to when it entered the second input port 397. Correspondingly, the water that exits the first output port 351 of the evaporator 350 and proceeds through the fourth intermediate conduit 361 has a lower temperature than when that water entered the first input port 382 of the evaporator.

Further with respect to this second subprocess, following the heat extraction at the evaporator 350, the refrigerant is communicated by the first further conduit 380 from the second output port 376 to the input port 378 of the compressor 358, where that refrigerant is compressed. Next, the compressed refrigerant exits the compressor 358 at the output port 384 and proceeds via the second further conduit 388 to the second input port 386 of the gas cooler 330. At the gas cooler 330, heat is (as discussed above in regard to the first subprocess) transferred to the water entering at the first input port 360 and exiting at the first output port 366, such that the refrigerant is cooled when it exits the gas cooler at the second output port 389. Further, the cooled refrigerant flows to enter the input port 390 of the expansion valve 354, at which expansion occurs. Finally, the cooled refrigerant (after expansion) flows from the output port 394 of the expansion valve 354 via the fourth further conduit 398 to the second input port 397 of the evaporator 350, at which heat extraction can again occur.

In addition to the aforementioned first and second subprocesses, the third method illustrated by FIG. 3 includes a third subprocess by which heated water is communicated to the first input port 382 of the evaporator 350 for extraction and heating of the refrigerant as described above in regard to the second subprocess. In the present embodiment, the third subprocess begins with the communication of water from the external heat source 301 by way of the source conduit 311 to the second input port 321 of the first external heat exchanger 322. Next, at the first external heat exchanger 322, residual heat accompanying the water received at the first input port 372 (after passing through the heating load 326) is extracted and transferred to the water received at the second input port 321, which consequently then exits the second output port 331 as heated water containing both the heat initially provided from the external heat source 301 as well as the heat transferred at the first external heat exchanger 322.

Further, the heated water exiting the second output port 331 then flows to the first input port 382 of the evaporator 350, at which heat is transferred away from that water to the refrigerant entering the second input port 397 for communication to the gas cooler 330 by way of operation of the heat pump 352. As a consequence of that heat transfer by the evaporator 350, the heated water that entered the first input port 382 is cooled and exits the evaporator by way of the first output port 351 as cooled water. That cooled water in turn flows from the first output port 351 via the fourth intermediate conduit 361 to the second input port 371 of the second external heat exchanger 340. Next, the second external heat exchanger 340 operates to extract heat remaining within the cold water received at the first input port 312 from the STST 302 and transfers that heat to the water received at the second input port 371, so as to lower the heat content (and cool the temperature) of the water received at the first input port 312 from the STST 302 so that the water is cooled when it exits that second external heat exchanger at the first output port 314. Due to the second external heat exchanger 340 absorbing heat from the water received at the first input port 312, the water passing from the second input port 371 to the second output port 381 is heated. That water then exits the second external heat exchanger 340 by way of the second output port 381, and from there proceeds by way of the source return conduit 391 to the external heat source 399.

It should be appreciated that the third method represented by FIG. 3 is only one example method of operation encompassed herein. Further, it should be understood that, depending upon the embodiment or circumstance, the first, second, and third subprocesses encompassed by the third method described above can be performed simultaneously with one another, or alternatively in other manners. For example, in some embodiments or circumstances, one or more of the first, second, and third subprocesses can be performed sequentially or in an alternating manner.

The third system 300 and corresponding third method illustrated by FIG. 3 are particularly advantageous in that the third system and method operate in a manner that helps to prevent ice formation when the heat provided to the evaporator 350 (e.g., provided by way of the water received at the first input port 382) is from an external heat source in which the heat transfer fluid or medium is water (e.g., a waterway, a lake, or a river). By virtue of operation of the third system 300 and the corresponding third method, the temperature of the water supplied from an external heat (or thermal) source such as the external heat source 301 is increased prior to that water being provided to an evaporator such as the evaporator 350. In particular, the third system 300 and corresponding third method increase the temperature of the water (heat transfer fluid) at the inlet (e.g., the first input port 382) of the evaporator by using heat transfer via an external heat exchanger (e.g., the first external heat exchanger 322) between the water received from the external heat source (e.g., the water received at the second input port 321) and the water exiting the heating load (e.g., the return from the heating load 326). This exchange makes it possible to prevent the formation of ice between the first input port 382 and the first output port 351 of the evaporator 350 or within the evaporator (e.g., in the water provided to the first input port 382 of and passing through the evaporator). That is, a risk of ice formation between the first input port 382 and first output port 351 of the evaporator 350 is reduced or eliminated due to the residual heat being received at the first external heat exchanger 322 from the heating load 326, extracted by that first external heat exchanger, and communicated from that first external heat exchanger to the evaporator by the water communicated between that first external heat exchanger and the first input port 382 of the evaporator.

It should be recognized that the present disclosure is intended to encompass numerous embodiments and arrangements in addition to the specific embodiments described above. For example, although each of the systems 100, 200, and 300 illustrated by FIGS. 1, 2, and 3 includes a single STST (e.g., the STST 102, the STST 201, or the STST 302), in alternate embodiments any of these systems can be modified to include more than one STST in series and/or in parallel, in which one or more of those STSTs is or are coupled to one or more heat pumps. Also it should be appreciated that, although in the embodiment of FIGS. 1, 2, and 3 only a single STST is employed, in alternate embodiments in which multiple STSTs are employed, conduits such as those shown in FIGS. 1, 2, and 3 can be coupled to each of the different STSTs. Further, other modified version of the systems 100, 200, and 300 and corresponding methods are encompassed by the present disclosure in which various additional connections/couplings are provided and/or in which the systems and/or methods are adapted for particular applications or with respect to particular environments.

Figure 4:
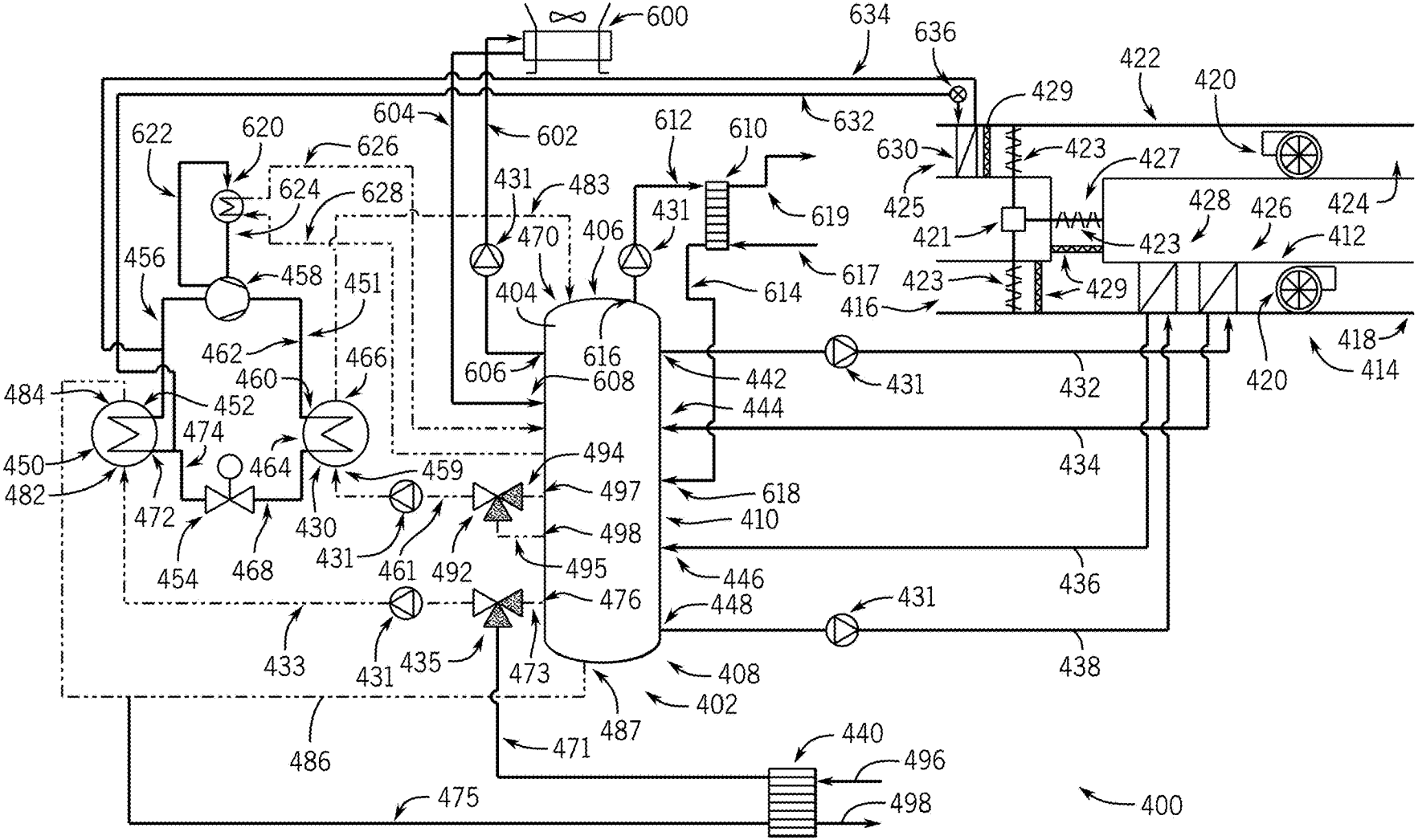
FIG. 4 is a schematic drawing showing a fourth system (and corresponding method) that is a modified embodiment of the system (and method) of FIG. 1, in accordance with a fourth example embodiment.

Additionally for example, with respect to FIG. 4, a schematic drawing shows a modified version of the first system 100 of FIG. 1, as a fourth system 400. As will be described further below, the fourth system 400 envisions each of heating a heating load, cooling of a cooling load, and heat recovery operation, as well as envisions obtaining heat from a geothermal heat source. As shown, the fourth system 400 includes a STST 402 with an interior chamber 404, a hot section 406, a cold section 408, and a thermocline section 410, which respectively correspond to, and can be considered identical to, the STST 102, interior chamber 104, hot section 106, cold section 108, and thermocline section 110 of the first system 110.

Also as with the first system 100, the STST 402 is coupled to a heating load 426, which corresponds to the heating load 126, and a cooling load 428, which corresponds to the cooling load 128. First and second conduits 432 and 434, respectively, couple first and second locations 442 and 444, respectively, along the STST 402 with the heating load 426, and third and fourth conduits 436 and 438, respectively couple third and fourth locations 446, and 448 respectively along the STST with the cooling load 428. The conduits 432, 434, 436, and 438 respectively correspond to, and can be identical to, the conduits 132, 134, 136, and 138 of FIG. 1. Likewise, the first, second, third, and fourth locations 442, 444, 446, and 448 respectively correspond to, and can be identical to the first, second, third, and fourth locations 142, 144, 146, and 148 of FIG. 1. Although not shown in FIG. 1, respective pumps 431 are shown to be positioned along the first conduit 132 and fourth conduit 138, and govern or facilitate water flow from the STST 402 to the heating load 426 and cooling load 428, respectively. The pumps 431 can take any of a variety of different forms depending upon the embodiment including, for example (but not limited to), centrifugal pumps.

In the embodiment of FIG. 4, each of the heating load 426 and cooling load 428 respectively is a respective heat exchanger or heat transfer device (for example, the heating load can be formed by a heating coil and the cooling load can be formed by a cooling coil). The heating load 426 and cooling load 428 are positioned sequentially (with the heating load downstream of the cooling load) in an air intake vent 412 of a heating, ventilation, and air conditioning (HVAC) system 414, between a fresh air entrance port 416 and a supply air exit port 418. Also as shown, the HVAC system 414 further includes a return air vent 422 having a return air entrance port 424 and an exhaust air exit port 425. It will be appreciated that air generally proceeds down the air intake vent 412 from the fresh air entrance port 416, which it enters as fresh air, to the supply air exit port 418, which it exits as supply air. Further, air generally proceeds down the return air vent 422 from the air entrance port 424, which it enters as return air, to the exhaust air exit port 425, which it exits as exhaust air.

The return air vent 422 is coupled to a location along the air intake vent 412 between the fresh air entrance port 416 and the cooling load 428 by a recirculated air passage 427. Respective supply fans 420 are positioned along the air intake vent 412, between the heating load 426 and the supply air exit port 418, and along the return air vent 422 between the return air entrance port 424 and the recirculated air passage 427. Additionally, respective air filters 429 are positioned along each of the recirculated air passage 427, the air intake vent 412 (upstream of the recirculated air passage), and the return air vent 422 (downstream of the recirculated air passage). Further one or more damper motors 421 are coupled to respective dampers/vents 423 also positioned along each of the recirculated air passage 427 (closer to the return air vent 422 than to the air intake vent 412), the air intake vent (downstream of the respective air filter), and the return air vent 422 (between the respective air filter and the recirculated air passage).

Also in the embodiment of FIG. 4, the fourth system 400 includes a gas cooler 430, an evaporator 450, an external heat exchanger 440, an expansion valve 454, and a compressor 458, which respectively correspond to (and can be identical to) the gas cooler 130, evaporator 150, first external heat exchanger 140, first expansion valve 154, and compressor 158 of FIG. 1. First, second, third, and fourth further conduits 456, 462, 468 and 474 respectively couple a second output port 452 of the evaporator 450 to an input port of the compressor 458, an output port of the compressor to a second input port 460 of the gas cooler 430, a second output port 464 of the gas cooler to an input port of the expansion valve 454, and an output port of the expansion valve back to a second input port 472 of the evaporator. In this regard, the first, second, third and fourth further conduits 456, 462, 468, and 474 respectively correspond to (and can be identical to) the first, second, third, and fourth further conduits 256, 262, 268, and 274, and also the respective ports 452, 460, 464, and 472 respectively correspond to (and can be identical to) the ports 252, 260, 264, and 272 of FIG. 1.

The evaporator 450, compressor 458, gas cooler 430, and expansion valve 454, together with the conduits 456, 462, 468, and 474 operate as a heat pump 451 in the same (or substantially the same manner) as the first heat pump 190 of FIG. 1. Again, the heat pump 451 communicates heat by circulating refrigerant, and operates as a transcritical system in accordance with a transcritical cycle (or transcritical heat pump cycle) and/or performs transcritical refrigeration. Also, in this embodiment, the external heat exchanger 440 can be in communication with a geothermal heat source by way of respective input and output ports 496 and 498 that respectively correspond to the input and output ports 196 and 198 of FIG. 1.

Further in regard to the fourth system 400, a first output port 466 of the gas cooler 430 is coupled to a location 470 along the top of the STST 402 by way of a conduit 483 in the same manner as the first output port 166 of the gas cooler 130 is coupled to the location 170 by way of the conduit 168. However, otherwise the manner in which the heat pump 451 is coupled relative to the STST 402 in the fourth system 400 is somewhat different relative to the manner in which the heat pump 150 is coupled relative to the STST 102 in the first system 102. In this regard, a first input port 459 of the gas cooler 430 (which corresponds to the first input port 160 of FIG. 1) is coupled to the STST 402 in a manner corresponding to that shown in FIG. 2. More particularly, in FIG. 4, the first input port 459 is coupled by way of a conduit 461 to a first mixing (or three-way) valve 492, which additionally is coupled by way of first and second additional conduits 494 and 495, respectively, to first and second additional locations 497 and 498 along the thermocline section 410 of the STST 402. In this regard the conduit 461, first additional conduit 494, second additional conduit 495, first additional location 497, and second additional location 498 respectively correspond to (and can be identical to) the first additional conduit 162, fifth additional conduit 214, sixth additional conduit 220, location 216, and location 222 of FIGS. 1 and 2. Further, another of the pumps 431 is shown to be positioned along the conduit 461. With this arrangement, as discussed in regard to FIG. 2, the heat content of the water directed from the STST 402 can vary depending upon the actuation of the mixing valve 492.

Additionally, in the system 402, heated water is directed to the evaporator 450 in a manner that is somewhat different than the manner of the system 102. In the system 402, a first input port 482 of the evaporator 450 is coupled by way of a conduit 433 to an output port of a mixing (three-way) valve 435. Additionally, although a first input port of the mixing valve 435 is coupled by a conduit 473 to a location 476 along the thermocline section 410 in the same manner as the seventh additional conduit 234 couples the mixing valve 204 to the seventh additional location 236 in the embodiment of FIG. 2, a second input port of the mixing valve 435 is coupled by way of a conduit 471 to an output port of the first external heat exchanger 440. Further, although a first output port 484 of the evaporator 450 is coupled by a conduit 486 to a location 487 at the bottom of the cold section 408 of the STST 402 in the same manner as the conduit 186 links the first output port 184 to the location 188 in FIG. 1, FIG. 4 also shows the first output port 484 to be coupled by an additional conduit 475 (alone or in combination with a portion of the conduit 486) to an input port of the first external heat exchanger 440. With this arrangement, it should be appreciated that, give the positioning of a further one of the pumps 431 along the conduit 433, heat can be delivered to the evaporator 450 either from the thermocline section 410 of the STST 402 or from the first external heat exchanger 440, or both, depending upon the actuation of the mixing valve 435.

In addition to the above-described features, the fourth system 400 also includes several additional features that differ from those of the first system 100. First, the fourth system includes an outdoor cooler 600 (e.g., for air conditioning when there is excess heat, such as during the summer) that is coupled by way of first and second extra conduits 602 and 604, respectively, to first and second extra locations 606 and 608 along the STST 402. The first extra location 606 in this embodiment can be along the hot section 406 of the STST 402, and the second extra location 608 can be along the thermocline section 410 (or otherwise be vertically below the first extra location). In this embodiment, water can be pumped from the STST 402 by another of the pumps 431 that is arranged along the first extra conduit 602. Thus, with this arrangement, when there is excess heat within the STST 402, water can be pumped to the outdoor cooler 600 so that some heat is dissipated to the external environment, such that the water when returning to the second extra location 608 is cooled.

Second, the fourth system includes an additional external heat exchanger 610 by which a domestic hot water (DHW) system can be provided with hot water. More particularly, the additional external heat exchanger 610 is coupled by way of third and fourth extra conduits 612 and 614, respectively, to third and fourth extra locations 616 and 618 along the STST 402. The first extra location 616 in this embodiment can be at the top of the hot section 406 of the STST 402, and the second extra location 618 can be along the thermocline section 410 (or otherwise be vertically below the first extra location). In this embodiment, water can be pumped from the STST 402 by another of the pumps 431 that is arranged along the third extra conduit 612. Thus, with this arrangement, hot water can be pumped from the STST 402 to the additional external heat exchanger 610, at which heat is extracted from the water before it is returned to the fourth extra location 618. The extracted heat in turn is used to heat intake water 617, which is then output for use as output hot water 619.

Third, the fourth system includes an oil cooler 620 that is coupled by way of fifth and sixth extra conduits 622 and 624, respectively, to the compressor 458, by which the oil cooler receives oil from and returns oil to the compressor. Additionally, so as to obtain oil from and return oil to the compressor, respectively. Further as illustrated, the oil cooler 620 additionally is coupled by way of seventh and eight extra conduits 626 and 628, respectively, by way of which the oil cooler is coupled, respectively, to receive water from and return water to the thermocline section 410 of the STST 402. In this example, the eighth extra conduit 628 by way of which water is provided from the STST 402 is coupled to the thermocline section 410 at a location that is lower than a location at which the seventh extra conduit 626 is coupled to the thermocline section, consistent with operation in which the water received by the oil cooler from the STST 402 is cooler than the returned water.

Further, the fourth system includes a heat recovery (HR) unit 630 positioned between the respective filter 429 and the exhaust air exit port 425 of the HVAC system 414. The HR unit 630 is a direct or indirect expansion system that uses a refrigerant, a blend refrigerant, or a mixture of refrigerant(s), and the HR unit particularly serves to recover remaining heat contained in the exhaust air. The HR unit 630 is coupled by way of ninth and tenth extra conduits 632 and 634 respectively to the second input port 472 and the second output port 452 of the evaporator, respectively. By virtue of this operation, which can be controlled by a valve 636 positioned along the ninth extra conduit 632, additional heat from the exhaust air of the HVAC system 414 can be contribute to the heat transferred by way of the heat pump 451.

It should be recognized that the particular temperatures that can be experienced at different locations within the fourth system 400 during operation can vary widely depending upon a variety of factors including the characteristics of the heating load 426 and cooling load 428 and various operational circumstances.

Figure 5:
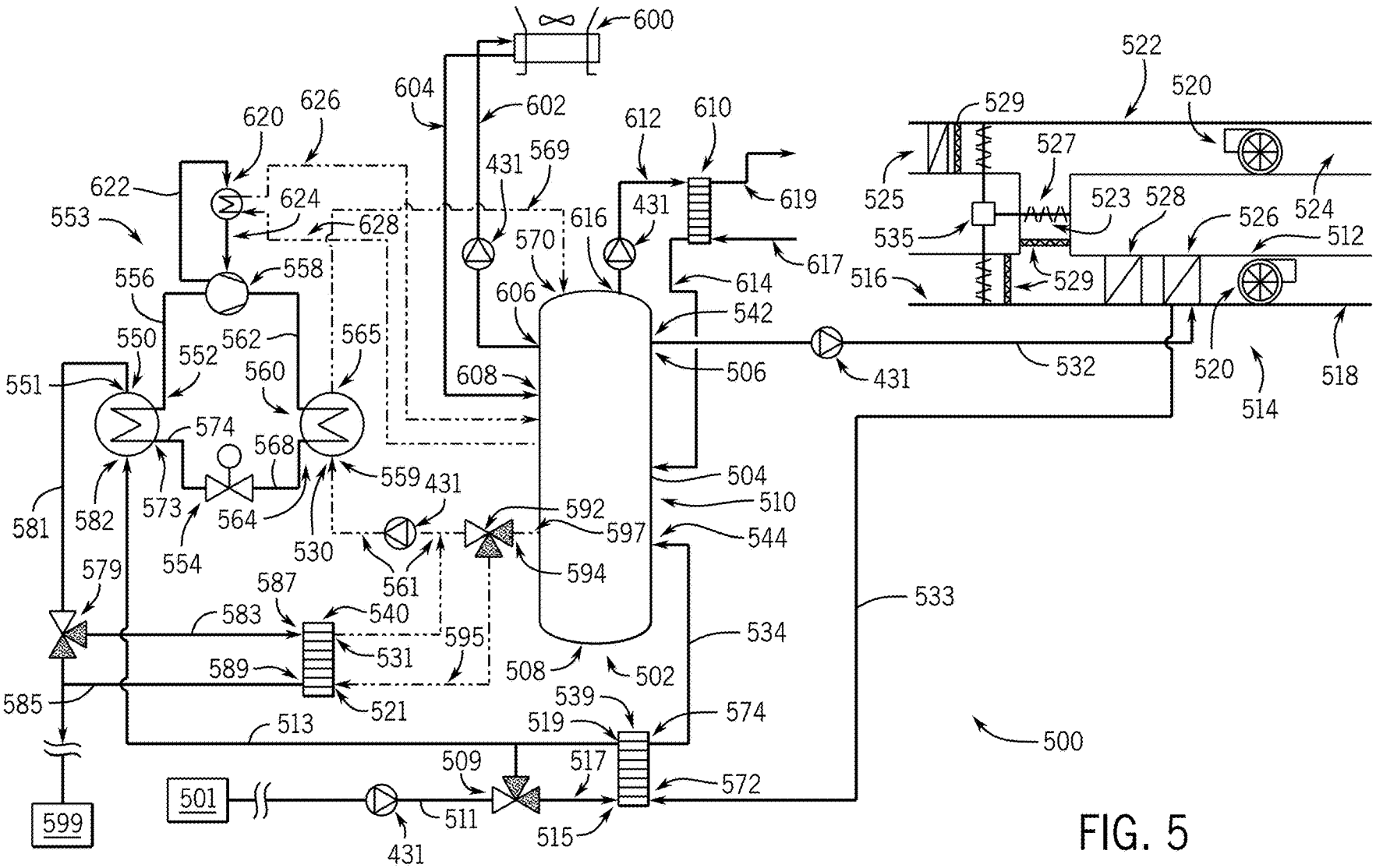
FIG. 5 is a schematic drawing showing a fifth system (and corresponding method) that is a modified embodiment of the system (and method) of FIG. 3, in accordance with a fifth example embodiment.

Turning next to FIG. 5, a further schematic drawing shows a modified version of the third system 300 of FIG. 3, as a fifth system 500. As will be described further below, the fifth system 500 again involves an open-loop heat source but, unlike the embodiment of FIG. 3, does not serve to cool any cooling load. As shown, the fifth system 500 includes a STST 502 with an interior chamber 504, a hot section 506, a cold section 508, and a thermocline section 510, which respectively correspond to, and can be considered identical to, the STST 302, interior chamber 304, hot section 306, cold section 308, and thermocline section 310 of the third system 310. Also as with the third system 300, the STST 502 is coupled to a heating load 526, which corresponds to the heating load 326. The heating load 526 is coupled to the STST 502 by way of a first conduit 532. Additionally, the STST 502 is also coupled to the heating load 526 indirectly by way of a first external heat exchanger 539. In this regard, a second conduit 534 links the STST 502 to the first external heat exchanger 539, and additionally a first intermediate conduit 533 links the external heat exchanger with the heating load 526.

More particularly, the heated water flows from the STST 502 to the heating load 526 via the first conduit 532, at which at least some of the heat from the heated water is discharged. The heated water, after passing through the heating load 526, next proceeds via the first intermediate conduit 533 to a first input port 572 of the first external heat exchanger 539, at which additional heat is discharged. The heated (now cooler) water then exits the first external heat exchanger 539 at a first output port 574 thereof, and returns to the STST 502 from the first external heat exchanger 539 by way of the second conduit 534. The conduits 532, 533, and 534 respectively correspond to, and can be identical to, the conduits 332, 324, and 334 of FIG. 3. Likewise, the first and second locations 542 and 544 respectively correspond to, and can be identical to, the first and second locations 542 and 544 of FIG. 3. Although not shown in FIG. 3, one of the pumps 431 (identical to any of those shown in FIG. 4) is shown to be positioned along the first conduit 532, and governs or facilitates water flow from the STST 502 to the heating load 526.

In the embodiment of FIG. 5, the heating load 526 is a heat exchanger or heat transfer device (for example, a heating coil) of a heating, ventilation, and air conditioning (HVAC) system 514. Similar to the HVAC system 414 of FIG. 4, the HVAC system 514 not only includes the heating load 526, which corresponds to the heating load 426, but also includes a cooling load 528 that is another heat exchanger or heat transfer device (for example, a cooling coil) positioned upstream of the heating load in an air intake vent 512, between a fresh air entrance port 516 and a supply air exit port 518. However, in this embodiment, the cooling load 528 is not coupled to the STST 502. Also the HVAC system 514 further includes a return air vent 522 having a return air entrance port 524 and an exhaust air exit port 525. It will be appreciated that air generally proceeds down the air intake vent 512 from the fresh air entrance port 516, which it enters as fresh air, to the supply air exit port 518, which it exits as supply air. Further, air generally proceeds down the return air vent 522 from the air entrance port 524, which it enters as return air, to the exhaust air exit port 525, which it exits as exhaust air.

Additionally, the return air vent 522 is coupled to a location along the air intake vent 512 between the fresh air entrance port 516 and the cooling load 528 by a recirculated air passage 527. Respective supply fans 520 are positioned along the air intake vent 512, between the heating load 526 and the supply air exit port 518, and along the return air vent 522 between the return air entrance port 524 and the recirculated air passage 527. Additionally, respective air filters 529 are positioned along each of the recirculated air passage 527, the air intake vent 512 (upstream of the recirculated air passage), and the return air vent 522 (downstream of the recirculated air passage). Further one or more damper motors 535 are coupled to respective dampers/vents 523 also positioned along each of the recirculated air passage 527 (closer to the return air vent 522 than to the air intake vent 512), the air intake vent (downstream of the respective air filter), and the return air vent 522 (between the respective air filter and the recirculated air passage).

Also in the embodiment of FIG. 5, the fifth system 500 includes a gas cooler 530, an evaporator 550, an expansion valve 554, a compressor 558, and a second external heat exchanger 540, which respectively correspond to (and can be identical to) the gas cooler 330, evaporator 350, first expansion valve 354, compressor 358, and second external heat exchanger 340 of FIG. 3. First, second, third, and fourth further conduits 556, 562, 568 and 574 respectively couple a second output port 552 of the evaporator 550 to an input port of the compressor 558, an output port of the compressor to a second input port 560 of the gas cooler 530, a second output port 564 of the gas cooler to an input port of the expansion valve 554, and an output port of the expansion valve back to a second input port 573 of the evaporator. In this regard, the first, second, third and fourth further conduits 556, 562, 568 and 574 respectively correspond to (and can be identical to) the first, second, third, and fourth further conduits 380, 388, 392, and 398, and also the respective ports 552, 560, 564, and 573 respectively correspond to (and can be identical to) the ports 376, 386, 389, and 397 of FIG. 3.

As with the third system 300 of FIG. 3, the gas cooler 530 in combination with the evaporator 550, expansion valve 554, and compressor 558 of the fifth system 500 of FIG. 5 can be understood to form a heat pump 553 by which heat is communicated to the gas cooler 530 in the same manner as described above. Again, the heat pump 553 communicates heat by circulating refrigerant, and operates as a transcritical system in accordance with a transcritical cycle (or transcritical heat pump cycle) and/or performs transcritical refrigeration. The heat particularly follows a cyclic portion or pathway in which refrigerant gains heat at the evaporator 550 and that heat is discharged at the gas cooler 530. The heat received by the gas cooler 530 due to operation of the heat pump 553 in turn can be transferred to water provided at least indirectly from the cold section 508 of the STST 502 to the gas cooler 530, so as to thereby generate heated water that is provided back to the hot section 506 of the STST.

Also similar to the third system 300 of FIG. 3, in the present embodiment, the heated water provided back to the hot section 506 of the STST 502 need not only be heated by way of the heat pump 553, but also can be heated due to operation of the first and second external heat exchangers 539 and 540. More particularly as shown, a first input port 521 of the second external heat exchanger 540 is coupled by way of a second additional conduit 595 to a first output port of a first mixing valve 592. Additionally, an input port of the first mixing valve 592 is coupled by way of a first additional conduit 594 to an additional location 597 along the STST 502 that is at the bottom of the STST, at or near the bottom of the cold section 506. Further, both a second output port of the first mixing valve 592 and a first output port 531 of the second external heat exchanger 540 are coupled by way of a first Y-shaped conduit 561 to a first input port 559 of the gas cooler 530. Additionally, a first output port 565 of the gas cooler 530 is coupled by way of a second intermediate conduit 569 to a second additional location 570 along the STST that is at the top of the STST, at the top of the hot section 506 of the STST. Also, one of the pumps 431 is arranged along the branch of the first Y-shaped conduit 561, between the first input port 559 and the junction between the branches of that conduit coupled to the first output port 531 and the first mixing valve 592.

Given this arrangement, it will be appreciated that, depending upon the actuation of the first mixing valve 592, cold water exiting the STST 502 by way of the first additional conduit 594 can be heated in any variety of manners. First, if the first mixing valve 592 is actuated to cause all incoming flow from the first additional conduit 594 to pass directly to the first Y-shaped conduit 561, then the heat content of the water returning to the STST 502 from the gas cooler 530 by way of the second intermediate conduit will be determined based upon the heating that occurs at the gas cooler 530 (in addition to the heat level of the water exiting the STST 502 via the first additional conduit 594). Alternatively, if the first mixing valve 592 is actuated to cause all incoming flow from the first additional conduit 594 to proceed to the second external heat exchanger 540 via the second additional conduit 595, then the heat content of the water returning to the STST 502 from the gas cooler 530 by way of the second intermediate conduit will be determined based upon the heating that occurs both at the gas cooler 530 itself (due to operation of the heat pump 553) as well as heating that occurs at the second external heat exchanger (as described further below).

Additionally, given that the first mixing valve 592 can be actuated to any of a variety of positions between these two alternatives, such that different portions of the water received via the first additional conduit 594 pass to the gas cooler 530 with and without passing through the second external heat exchanger 540, the heat content of the water returned to the STST 502 from the gas cooler 530 via the second intermediate conduit 569 can also take on any of a variety of intermediate levels depending upon how the mixing valve is actuated. That is depending upon the setting of the first mixing valve 592, the heat content of the water returned to the STST 502 from the gas cooler 530 via the second intermediate conduit 569 can take on any of a variety of values between a maximum value at which all of that water is heated by the second external heat exchanger 540 and a minimum value at which all of that water bypasses the second external heat exchanger.

Further in the present embodiment, the heat arriving at the evaporator 550, as provided by the water entering the first input port 582, can come from multiple sources. First, as with the third system 300 of FIG. 3, the fifth system 500 of FIG. 5 is directly connected to an external heat source 501 in an open-loop manner. Again, the external heat source 501 can include, for example, any one or more of a variety of ground, air, water, and/or other sources such as, also for example, a waterway, a lake, a river, a geothermal heat source, or a waste heat source. Further as shown, a source conduit 511 (shown with break lines) links the external heat source 501 to an input port of a second mixing valve 509, and a further conduit 517 links a first output port of the second mixing valve to a second input port 515 of the first external heat exchanger 539, so as to allow for the communication of externally-heated water from that external heat source to the first external heat exchanger. Additionally, a second Y-shaped conduit 513 couples a first input port 582 of the evaporator 550 to each of a second output port of second mixing valve 509 and also to a second output port 519 of the first external heat exchanger 539. Notwithstanding the above discussion, it should be appreciated that, depending upon the embodiment, the system may be implemented in an open-loop manner and/or a closed-loop manner—that is, the present disclosure encompasses each of open-loop and/or closed-loop systems and arrangements.

It will be appreciated that, depending upon the actuation of the second mixing valve 509, the water reaching the first input port 582 of the evaporator 550 can be provided with different amounts of heat. First, if the second mixing valve 509 is actuated to cause all incoming flow from the first external heat source 501 to pass directly to the second Y-shaped conduit 513 (and thereby to bypass the first external heat exchanger 539), then the heat content of the water arriving at the first input port 582 of the evaporator 550 will be at a level solely determined by the first external heat source. Alternatively, if the second mixing valve 509 is actuated to cause all incoming flow from the first external heat source 501 to proceed to the second input port 515 of the first external heat exchanger 539, then all of the water reaching the first input port 582 of the evaporator 550 will not only include heat provided from the first external heat source 501 but also will include heat provided via operation of the first external heat exchanger 539. That heat particularly will include residual heat from the heated water provided by the hot section 506 of the STST 502 left over after that heated water has passed through the heating load 526.

Additionally, given that the second mixing valve 509 can be actuated to any of a variety of positions between these two alternatives, such that different portions of the water received via the source conduit 511 pass to the evaporator 550 with and without passing through the first external heat exchanger 539, and thus can take on any of a variety of intermediate levels depending upon how the mixing valve is actuated. That is depending upon the setting of the second mixing valve 509, the heat content of the water provided to the evaporator 550 via the second Y-shaped conduit 513 can take on any of a variety of values between a maximum value at which all of that water is heated by the first external heat exchanger 539 and a minimum value at which all of that water bypasses the first external heat exchanger.

Although the evaporator 550 extracts at least some of the heat contained in the water received at the first input port 582, for delivery by the heat pump 553 to the gas cooler 530, typically some of that received heat is not extracted by the evaporator but rather exits the evaporator along with that water by way of a first output port 551 of the evaporator. In the present embodiment, the first output port 551 of the evaporator 550 is coupled via a fourth intermediate conduit 581 to an input port of a third mixing valve 579. Additionally, a first output port of the third mixing valve 579 is coupled by way of a further conduit 583 to a second input port 587 of the second external heat exchanger 540. Also, a third Y-shaped conduit 585 (shown with break lines) couples each of a second output port of the third mixing valve 579 and a second output port 589 of the second external heat exchanger 540 to an external heat source 599. The external heat source 599 can be, but need not be, the same external heat source as the external heat source 501.

It will further be appreciated that, depending upon the actuation of the third mixing valve 579, residual heat exiting (not extracted by) the evaporator 550 can but need not be communicated to the second external heat exchanger 540. That is, if the third mixing valve 579 is actuated to cause all incoming flow from the first output port 551 of the evaporator to pass directly to the third Y-shaped conduit 585 (and thereby to bypass the second external heat exchanger 540), then all residual heat exiting the evaporator is simply returned to the external heat source 599. Alternatively, if the third mixing valve 579 is actuated to cause all incoming flow from the evaporator 550 to proceed to the second input port 587 of the second external heat exchanger 540 rather than merely bypassing that heat exchanger, then all of that water will pass through that heat exchanger prior to being returned to the external heat source. Further, in the present embodiment, the third mixing valve 579 can also be actuated to any of a variety of intermediate positions so that various portions of the water received from the evaporator 550 are directed to pass through the second external heat exchanger 540 before proceeding to the external heat source 599 but other portions pass directly to the external heat source.

Assuming that the third mixing valve 579 is in fact actuated to direct at least some of the water from the evaporator 550 to proceed through the second external heat exchanger 540, and further assuming that the first mixing valve 592 is actuated so as to direct some or all of the water received via the first additional conduit 594 to also pass through the second external heat exchanger 540 before proceeding to the gas cooler 530, then some or all of the water that leaves the evaporator 550 can still be used to influence the temperature of the water provided to the gas cooler 530 at the first input port 559. More particularly, in such a circumstance, the cold water received initially at the first mixing valve 592 via the first additional conduit 594 will be cooled by way of the second external heat exchanger 540 (as that water passes between the ports 521 and 531) before being heated at the gas cooler 530, by way of the water leaving the evaporator 550 via the conduit 581 and passing through the second external heat exchanger 540.

In this regard, it should be appreciated that, in some circumstances, the temperature of the water exiting the STST 502 via the first additional conduit 594 can be too high for the gas cooler 530. This can occur when the temperature is too high in the STST section at or proximate the additional location 597 from which that water is drawn. For example, if the heating load 526 requirements are high over a long period of time (or when, as shown in FIG. 5, there is no requirement imposed by any cooling load), the temperature of the water within the STST 502 at or proximate the additional location 597 may increase to a level that is undesirable for the gas cooler 530. Also for example, the temperature of the water within the STST 502 at or proximate the additional location 597 may increase to a level that is undesirable for the gas cooler 530 if there is a destratification of the water within the STST 502 such that the temperature(s) at the bottom of the STST becomes higher and the temperature(s) at the top of the STST become lower.

In such circumstances, the second external heat exchanger 540 can operate to reduce the temperature of the water received via the first additional conduit 594 before that water is provided to the gas cooler 530. That is, assuming that the first mixing valve 592 is set to direct that water (or some portion of that water received via the additional conduit) to the first input port 521 of the second external heat exchanger 540 via the second additional conduit 595, and assuming that the third mixing valve 579 is set to direct the water received from the evaporator 550 via the fourth intermediate conduit 581 to the second input port 587 of the second external heat exchanger via the further conduit 583, the second external heat exchanger can operate to transfer some of the heat from former water to the latter water. As a result of that heat transfer, the water that exits the second heat exchanger 540 via the second output port 589 is warmer than when it entered the second input port 587, and the water that exits the second heat exchanger 540 via the first output port 531 and proceeds to the gas cooler 530 via the first Y-shaped conduit 561 is cooler than when that water entered the first input port 521. Thus the water provided to the gas cooler 530, upon being so cooled by the second heat exchanger 540, is more suitable for the gas cooler and may also help to prevent any compressor shutdown that might occur if the input water temperature at the gas cooler was too high.

Although the above-described manner of operation envisions directing water through the second external heat exchanger 540 so as to cool the water received from the STST 502 via the first additional conduit 594 prior to directing that water to the gas cooler 530, such operation is typically unnecessary. Rather, during normal operating conditions (or ideally), it is not desirable to pre-cool the water before it is provided to the gas cooler 530 (or to employ the second external heat exchanger 540 for this purpose), because such operation involves rejecting (or directing) heat to the environment or at the exterior. Further, although this manner of operation involving pre-cooling of the water provided to the gas cooler 530 is particularly described in regard to the fifth system 500 of FIG. 5, it should be appreciated that such pre-cooling operation can also be implemented in other embodiments. For example, as already discussed above, the second external heat exchanger 340 of the third system 300 of FIG. 3 in some circumstances can serve to cool the water received at the first input port 312 before that water is provided to the gas cooler 330, by extracting heat from that water and transferring that heat to the water received from the evaporator 350 at the second input port 371. Thus, the second external heat exchanger 540 of FIG. 5 and the second external heat exchanger 340 of FIG. 3 can participate in conditioning the respective input water temperature at the respective gas coolers 530 and 330 with which the respective heat exchangers are coupled, particularly by cooling the water being provided to the respective first input ports 559 and 360 with which the respective heat exchangers are coupled.

Further, although the first, second, and fourth systems 100, 200, and 400 of FIGS. 1, 2, and 4 lack any external heat exchanger(s) that are positioned between the respective first input ports 160 and 459 of the respective gas coolers 130 and 430 of those systems and the respective locations 164, 216, 222, 497, 498 along the respective STSTs 102, 201, and 402 from which water is provided to those respective gas coolers, the present disclosure also encompasses alternate embodiments of those systems in which external heat exchanger(s) are so positioned. In such alternate embodiments, such external heat exchanger(s) can again perform operations that tend to affect the temperature of the water that is provided to the respective first input ports 160 and 459 of the respective gas coolers 130 and 430 of the first, second, and fourth systems 100, 200, and 400. Additionally, in further alternate embodiments, an external heat exchanger positioned relative to the input port of one of the gas coolers as described above (such as the second external heat exchangers 340 and 540 of FIGS. 3 and 5) can be replaced by an internal heat exchanger between the output port of the gas cooler (higher pressure section) and (or with) the lower pressure section of the refrigerant cycle.

In addition to the above-described features, the fifth system 500 again includes several additional features that differ from those of the third system 300, but which are present in the fourth system 400 of FIG. 4. In particular, the fifth system 500 again includes the outdoor cooler 600 that is coupled by way of first and second extra conduits 602 and 604, respectively, including the pump 431 along the first extra conduit 602, to the first and second extra locations 606 and 608 along the STST 502 (which can be understood to be identical to the locations 606 and 608 along the STST 402). Also, the fifth system 500 includes the additional external heat exchanger 610 for a DHW system by which the output hot water 619 is generated from the heat intake water 617. Again in this embodiment, the additional external heat exchanger 610 is coupled by way of the third and fourth extra conduits 612 and 614, respectively, including the pump 431 along the third extra conduit 612, to the third and fourth extra locations 616 and 618 along the STST 502 (which can be understood to be identical to the locations 606 and 608 along the STST 402). Further, the fifth system 500 additionally includes the oil cooler 620 that is coupled by way of fifth and sixth extra conduits 622 and 624, respectively, to the compressor 558 (which can be considered identical to the compressor 458 of FIG. 4). Also, the oil cooler 620 again is additionally coupled to the STST 502 by way of seventh and eight extra conduits 626 and 628, respectively, by way of which water is provided to and from the STST (e.g., in the same manner as shown in FIG. 4).

It should be recognized that the particular temperatures that can be experienced at different locations within the fifth system 500 during operation can vary widely depending upon a variety of factors including the characteristics of the heating load 526 and cooling load 528 and various operational circumstances.

The embodiments of heating and/or cooling systems encompassed by the present disclosure can be advantageous in any of one or more respects. For example, through the use of one or more of the systems encompassed herein, and/or associated methods of operation, it is possible to create favorable conditions for the optimal operation of a heat pump by controlling one or more normally-uncontrollable operating vagaries (e.g., temperature fluctuation or load variation). Thus, it is possible to exercise control over operating parameters of a fluctuating nature to be able to operate a heat pump under optimal and stable conditions for which it has been sized. Indeed, by having control over a greater number of input parameters, the heat pump can be operated around its design point, thus maximizing its effectiveness. Such a conditioning strategy makes it possible to use and recover the residual energy that would otherwise be trapped in the system. This energy in turn contributes to the system's performance by adding to the energy that the heat pump absorbs at the source.

More particularly, through the use of one or more of the systems employing STSTs encompassed herein, and/or associated methods of operation, it is possible to prevent one parameter from influencing another one. For example, in some such embodiments that employ an STST, supply water streams to an evaporator and to a heat pump's gas cooler of such a system, as well as water streams entering and leaving heating and cooling loads of such a system, are coupled only indirectly through (or by way of) the STST. Because the STST in such embodiments serves as an intermediary between these various streams, the STST allows for those streams to be largely or entirely independent of one another.

In addition to the embodiments and arrangements described above, it should be understood that the present disclosure encompasses numerous further embodiments and arrangements of heating and/or cooling systems (and associated apparatuses or components such as various embodiments and arrangements of heat pumps) and associated methods in addition to those described above. The present disclosure is intended to encompass any of a variety of embodiments and arrangements of improved heating and/or cooling systems and methods for heating or cooling large structures, areas, or environments, including (for example, but not limited to) a commercial and/or institutional building or manufacturing facility. In some additional embodiments, for example, the present disclosure relates to improved heating and/or cooling systems and methods for performing space heating in buildings or groups of buildings within a city, or a city section, or otherwise for space (e.g., large space) heating purposes.

As already noted above, although carbon dioxide ($CO_2$) can be utilized as a refrigerant (e.g., within the heat pumps of the systems described above), the present disclosure is also intended to include embodiments and arrangements that utilize other types of refrigerants, particularly refrigerants that can be employed for operation in accordance with a transcritical cycle. Also, although the embodiments described above envision STSTs that hold or store water, and relatedly envision operation in which heat is communicated by way of the flow of water to and from the STSTs, the present disclosure also encompasses where one or more other fluids (or other media) can be held, stored, or communicated including, for example, one or more of another fluid, another liquid, or one or more first gases. Further, although several of the embodiments described above envision communication by the systems with one or more external thermal sources from which water (and associated heat) can be obtained and to which water (and associated) can be returned, the present disclosure also encompasses embodiments in which such a medium for communicating heat to or from one or more external thermal sources takes another form, such as one or more of a further fluid or further liquid, or one or more gases.

Additionally for example, although the first, second, third, fourth, and fifth systems 100, 200, 300, 400, and 500 described with respect to FIGS. 1, 2, 3, 4, and 5 herein envision the implementation of a single STST, the present disclosure also encompasses alternate embodiments in which multiple STSTs are implemented in a given heating and/or cooling system. Also, the present disclosure also encompasses alternate embodiments in which one or more other types of thermal storage tanks are employed alone or in combination with one or more STSTs (again, when multiple tanks are combined, these can be coupled with one another in series or in parallel). Further, the present disclosure includes embodiments employing one or more STSTs or other thermal storage tanks having any of a variety of different sizes and/or water (or other fluid) holding capacities (for example, but not limited to, a STST that is 10-12 feet tall or 30 feet tall).

Further, the present disclosure also encompasses alternate embodiments in which one or more heat pumps of any of a variety of types is or are employed in a given heating and/or cooling system. For example, although the above description envisions the use of one or more heat pumps that employ carbon dioxide ($CO_2$) as a refrigerant that circulates between an evaporator and a gas cooler, the present disclosure also encompasses other embodiments in which other refrigerants are used. Also, the present disclosure is intended to encompass embodiments involving any of water-to-water and air-to-water heat pumps, as well as to embodiments employing any other type of heat transfer fluid at the heat source (e.g., liquid or gas). Further for example, heat transfer units in combination with compression units (e.g., employing $CO_2$) can be employed. Additionally, the systems, components, or devices employed to serve as heat pumps or otherwise to communicate heat between different locations can be implemented on one skid, two skids, or in any of a variety of other manners depending upon the embodiment.

Additionally, the present disclosure is intended to encompass any of a variety of different embodiments and arrangements that include or operate in relation to any one or more of a variety of types of heat sources. As already mentioned above, the present disclosure includes embodiments and arrangements that include or operate, for example, in relation any one or more of a variety of ground, air, water, and/or other sources such as, also for example, a waterway, a lake, a river, a geothermal heat source, or a waste heat source. Further for example, the present disclosure encompasses embodiments and arrangements that include or operate in relation to example heat source(s) that are internal (e.g., air-conditioning load return, cooling tower, or exhaust air), and/or heat source(s) that are external (e.g., outdoor air, rivers, lakes, waterways, or geothermal sources), as well as hybrids of various types of heat source(s). The present disclosure is also intended to encompass embodiments that are applied for use with, or involve, thermal storage of distributed energy resources (e.g., solar energy, wind energy).

Additionally, the present disclosure encompasses a variety of methods and processes and is not limited to the specific methods and processes described above. For example, to the extent that one or more of the methods described above are described as involving multiple subprocesses, depending upon the embodiment or circumstance those subprocesses can all be performed simultaneously or substantially simultaneously or alternatively in a sequential manner.

Further, the present disclosure is also intended to encompass embodiment that include or operate in conjunction with any of a variety of different types of controllers, control mechanisms, processors, computers, actuators, and other devices, apparatuses, mechanisms, or systems that perform or allow for the performing of control and/or monitoring functioning with regard to any of the systems (and portions of any of the systems) described or encompassed herein. Among other things, the present disclosure is intended to encompass embodiments that operate or in conjunction with any such devices, apparatuses, mechanisms, or systems both if such devices, apparatuses, mechanisms, or systems are local or if such devices, apparatuses, mechanisms, or systems are remote, including arrangements in which communication signals for control or monitoring purposes are achieved by wired or wireless communication systems.

Additionally, the present disclosure in some embodiments relates to a heating and cooling system configured to perform water temperature conditioning. The heating and cooling system includes a stratified thermal storage tank (STST) having an interior region extending between a first end and a second end, where the interior region includes a hot section at or proximate to the first end, a cold section at or proximate to the second end, and a thermocline section in between the hot and cold sections, and where the STST includes within the interior region a plurality of portions of a fluid respectively having successively decreasing temperatures successively distributed from the first end to the second end. Further, the system also includes first and second conduits respectively coupled to the STST at a first location along the hot section and at a second location along the thermocline section, where the first and second conduits are configured to be coupled at least indirectly to a heating load so that at least a first amount of the fluid can flow between the STST and the heating load.

Also, the system includes a first heat pump including a first evaporator and a gas cooler. A first output port of the gas cooler is coupled at least indirectly to a first additional location along the STST and a first input port of the gas cooler is coupled at least indirectly to a second additional location along the STST so that at least a second amount of the fluid can flow between the STST and the gas cooler. Further, a first input port of the first evaporator is coupled to a third additional location along the STST and a first output port of the first evaporator is coupled to a fourth additional location along the STST, so that at least a third amount of the fluid can flow between the STST and the first evaporator, where the first and fourth additional locations are respectively at or proximate to the first and second ends, respectively, and each of the second and third additional locations is between the first and fourth additional locations. Additionally, the first evaporator is coupled to the gas cooler, and the first heat pump is configured to cycle therewithin a refrigerant between the first evaporator and the gas cooler, so that first heat transported from the STST by the third amount of the fluid to the first evaporator is communicated by way of the first heat pump to the gas cooler and then transported from the gas cooler by the second amount of fluid to the hot section of the STST, whereby at least some of the first heat can be further transported by the first amount of fluid via the first conduit for receipt by the heating load.

Further, in at least some such embodiments, the refrigerant includes carbon dioxide ($CO_2$), and wherein the fluid is water. Additionally, in at least some such embodiments, the system additionally comprises first, second, third, and fourth additional conduits respectively coupled to the STST at the first, second, third, and fourth additional locations along the STST, where the third additional location is between the second and fourth additional locations, where the first output port of the gas cooler is coupled to the STST at least indirectly by the first additional conduit and the first input port of the gas cooler is coupled to the STST at least indirectly by the second additional conduit, and where the first input port of the first evaporator is coupled to the STST at least indirectly by the third additional conduit and the first output port of the first evaporator is coupled to the STST at least indirectly by the fourth additional conduit. The first heat pump is configured to cycle therewithin the refrigerant from a second output port of the first evaporator to a second input port the gas cooler and back from a second output port of the gas cooler to a second input port of the first evaporator.

Additionally, in at least some such embodiments, the first heat pump additionally includes a compressor and a first expansion valve, where the compressor is coupled between the second output port of the first evaporator and the second input port of the first gas cooler, and where the first expansion valve is coupled between the second output port of the first gas cooler and the second input port of the first evaporator. Also, in at least some such embodiments, the system further comprises a second heat pump, where the second heat pump includes a second evaporator and a second expansion valve, where an output port of the second expansion valve is coupled to an input port of the second evaporator, where the compressor is additionally coupled between the second input port of the first gas cooler and an output port of the second evaporator, and where an input port of the second expansion valve is additionally coupled to the second output port of the gas cooler. Further, in at least some such embodiments, the second evaporator includes a further input port and a further output port by which the second evaporator can interact with a medium and extract second heat from the medium, where the second heat pump operates to communicate the second heat to the first gas cooler, and the second heat is additionally transported from the first gas cooler by the second amount of fluid via the first additional conduit to the hot section of the interior region of the STST, whereby at least some of the second heat can be further transported by the first amount of fluid via the first conduit for receipt by the heating load.

Further, in at least some such embodiments, the system further includes a first external heat exchanger, where a first input port of the first external heat exchanger is coupled to the third additional location by way of the third additional conduit and a first output port of the first external heat exchanger is coupled to the first input port of the evaporator, and where the first external heat exchanger includes a further input port and a further output port by which the first external heat exchanger is able to communicate, by way a flowing medium, with an auxiliary or external heat source so as to receive second heat from the auxiliary or external heat source, whereby the first heat exchanger serves to integrate, at least indirectly, the auxiliary or external heat source into heating and cooling system. Also, in at least some such embodiments, the first external heat exchanger causes the second heat to be provided to the third amount of fluid so that both the first heat and the second heat are received by the first evaporator, where the first heat pump additionally operates so that the second heat is communicated to the gas cooler, where the second heat is additionally transported from the gas cooler by the second amount of fluid via the first additional conduit to the hot section of the interior region of the STST, whereby at least some of the second heat can be further transported by the first amount of fluid via the first conduit for receipt by the heating load.

Additionally, in at least some such embodiments, system also includes a first mixing valve, where a first input port of the first mixing valve is coupled to the second additional location by way of the second additional conduit, where a second input port of the first mixing valve is coupled to a fifth additional location along the STST by way of a fifth additional conduit, and where an output port of the first mixing valve is coupled to the first input port of the gas cooler. Also, in at least some such embodiments, system further comprises a second mixing valve, where a first input port of the second mixing valve is coupled to the third additional location by way of the third additional conduit, where a second input port of the second mixing valve is coupled to a sixth additional location along the STST by way of a sixth additional conduit, where an output port of the second mixing valve is coupled at least indirectly to the first input port of the first evaporator, and where each of the first and sixth additional locations is along the thermocline section of the STST. Further, in at least some such embodiments, the system also includes a second mixing valve, where a first port of the second mixing valve is coupled to the third additional location by way of the third additional conduit, where a second port of the second mixing valve is coupled to a first port of an external heat exchanger, where a third port of the second mixing valve is coupled at least indirectly to the first input port of the first evaporator, and where a second port of the external heat exchanger is coupled at least indirectly to the fourth additional location.

Further, in at least some such embodiments, the system also includes third and fourth second conduits respectively coupled to the STST at third and fourth locations, respectively, along the STST, where the fourth location is at or proximate to the second end of the STST and the third location is between the second and fourth locations, where the third and fourth conduits are configured to be coupled at least indirectly to a cooling load so that at least a fourth amount of the fluid can flow between the STST and the cooling load. Also, in at least some such embodiments, the system further includes first and second pumps, where the first pump is arranged along the first conduit so that the first amount of the fluid is directed to flow through the first conduit away from the first location and through the second conduit toward the second location, and where the second pump is arranged along the fourth conduit so that the fourth amount of the fluid is directed to flow through the fourth conduit away from the fourth location and through the third conduit toward the third location.

Additionally, in at least some such embodiments, the system also includes at least one part of a heating, ventilation, and air conditioning (HVAC) system for a building including the heating load and the cooling load, where the heating load is a space heating load including a first heat exchanger and the cooling load including a second heat exchanger. Also, in at least some such embodiments, the system further includes one or both of: a heat recovery (HR) unit of the HVAC system and further conduits by which the HR unit is coupled at least indirectly to the second input port and second output port of the first evaporator; or a heat exchanger coupled between the first input port of the gas cooler and the second additional location along the STST, where the heat exchanger operates to modify a temperature of the second amount of the fluid prior to the second amount of the fluid being provided to the gas cooler. Further, in at least some such embodiments, the system also includes one or more of: (a) a compressor coupled between the first evaporator and the gas cooler, and an oil cooler coupled to the compressor and additionally coupled to the STST, so that additional heat can be extracted from the compressor via the oil cooler and returned to the STST; (b) a domestic hot water (DHW) system heat exchanger coupled at least indirectly to the STST; and (c) an outdoor cooler coupled at least indirectly to the STST.

Further, the present disclosure in at least some embodiments relates to a method of operating a heating and cooling system at least in part by performing water temperature conditioning. The method includes providing each of (a) a stratified thermal storage tank (STST) having an interior region and including within the interior region a fluid having a decreasing temperature distribution from a first end to a second end of the STST, (b) first and second conduits respectively coupled to the STST at a first location proximate the first end and at a second location along a midsection between the first and second ends, (c) first, second, third, and fourth additional conduits respectively coupled to the STST at first, second, third, and fourth additional locations along the STST, where the first and fourth additional locations are respectively at or proximate to the first and second ends, respectively, the second additional location is between the first and fourth additional locations, and the third additional location is between the second and fourth additional locations, and (d) a heat pump including a first evaporator and a first gas cooler, where a first output port of the gas cooler is coupled to the STST at least indirectly by the first additional conduit and a first input port of the first gas cooler is coupled to the STST at least indirectly by the second additional conduit, where a first input port of the evaporator is coupled to the STST at least indirectly by the third additional conduit, and where a first output port of the evaporator is coupled to the STST at least indirectly by the fourth additional conduit.

The method additionally includes causing a first amount of the fluid to flow, via the third additional conduit, from the third additional location to the first input port of the evaporator so that first heat is transported to the evaporator, and transporting the first heat by way of flowing refrigerant within the heat pump from the evaporator to the gas cooler. The method also includes causing a second amount of the fluid to flow from the second additional location to the first additional location, via the second and first additional conduits and through the gas cooler, so that the second amount of the fluid receives the first heat at the gas cooler and so that the first heat is delivered to the interior of the STST by way of the first additional location. Further, the method includes pumping a third amount of the fluid to flow from the first location via the first conduit for receipt by the heating load, so that at least a portion of the first heat is delivered to the heating load.

Also, in at least some such embodiments, the providing further includes providing third and fourth conduits respectively coupled to the STST at a third location along the midsection and a fourth location proximate the second end, wherein the first amount of the fluid is caused to additionally flow, via the fourth additional conduit, from an output port of the evaporator back to the fourth additional location. Further, in at least some such embodiments, the method further includes pumping a fourth amount of the fluid to flow from the fourth location via the fourth conduit for receipt by the cooling load and additionally to return from the cooling load to the third location via the third conduit, where second heat is delivered to the STST from the cooling load, and where at least a portion of the second heat is communicated to the evaporator.

Also, the present disclosure in at least some embodiments relates to a heating and cooling system configured to perform water temperature conditioning. The system includes a first stratified thermal storage tank (STST) having, within an interior region thereof, a fluid having a decreasing temperature distribution from a first end to a second end of the STST. Additionally, the system includes first and second conduits respectively coupled to the STST at first and second locations, respectively, the first location being proximate the first end and the second location being along a thermocline section of the interior region between the first and second ends, where the conduits are configured to be coupled at least indirectly to a heating load so that a first amount of the fluid can flow between the STST and the heating load. Further, the system includes a mixing valve having first and second input ports respectively coupled by first and second additional conduits, respectively, to first and second additional locations along the STST, respectively, where the first and second additional locations are between the first and second ends, respectively.

Additionally, the system includes a heat pump including an evaporator and a gas cooler. A first output port of the gas cooler is coupled by a third additional conduit to a third additional location proximate the first end of the STST and a first input port of the first gas cooler is coupled to an output port of the mixing valve, so that at least a second amount of the fluid can flow between the STST and the gas cooler via the mixing valve. Also, a first input port of the evaporator is coupled to the STST at least indirectly by a fourth additional conduit and a first output port of the evaporator is coupled to the STST at least indirectly by a fifth additional conduit, so that at least a third amount of the fluid can flow between the STST and the evaporator. Further, the heat pump operates to circulate therewithin a refrigerant between the evaporator and the gas cooler in accordance with a transcritical cycle, so that first heat transported from the STST to the evaporator by the third amount of the fluid is communicated by way of the heat pump to the gas cooler and then delivered from the gas cooler by the second amount of fluid to a hot section of the interior region of the STST proximate the first end, whereby at least some of the first heat can be further transported by the first amount of fluid via the first conduit for receipt by the load.

Additionally, in at least some such embodiments, the system further comprises third and fourth conduits respectively coupled to the STST at a third location along the midsection and a fourth location proximate the second end, where the third and fourth conduits are configured to be coupled at least indirectly to a heat source so that a second amount of the fluid can flow between the STST and the heat source. Also, the refrigerant includes carbon dioxide ($CO_2$), and an additional mixing valve at least partly governs the third amount of the fluid that can flow between the first STST and the first evaporator. Further, either: (a) the system only includes the first STST and does not include any other STST; or (b) the system includes a plurality of STSTs including both the first STST and one or more additional STSTs, where the first STST and one or more additional STSTs of the plurality of STSTs are coupled in parallel and/or in series and where, in addition to the first, second, third, and fourth conduits being coupled to the first STST, one or more additional conduits or other connections are distributed for coupling in relation to the one or more additional STSTs.

Additionally, the present disclosure in at least some embodiments relates to a heating and cooling system configured to perform water temperature conditioning. The system includes a stratified thermal storage tank (STST) having an interior region extending between a first end and a second end, where the STST includes a plurality of portions of a fluid respectively having successively decreasing temperatures successively distributed from a hot section proximate the first end to a cold section proximate the second end. The system also includes first and second conduits respectively coupled to the STST at first and second locations, respectively, the first conduit also being configured to be coupled to a heating load. Further, the system includes a first heat exchanger, where the second conduit is coupled between the second location and a first output port of the first heat exchanger, and where a first intermediate conduit is coupled to a first input port of the first heat exchanger and configured to be coupled to the heating load, so that a first amount of the fluid can flow from the STST to the heating load and then to the first heat exchanger, and so that first residual heat carried by the first amount of the fluid and not absorbed by the heating load can be received by the heat exchanger.

Additionally, the system includes a heat pump including an evaporator and a gas cooler, where a first output port and a first input port of the gas cooler are respectively coupled at least indirectly to first and second additional locations, respectively, along the STST, so that a second amount of the fluid can flow from the STST to and through the first gas cooler and then return to the STST. A second input port of the first heat exchanger is configured to receive a medium from a first external source, and a second output port of the first heat exchanger is coupled to a first input port of the evaporator, so that the medium can flow from the first external source through the first heat exchanger and to the evaporator and transport first heat to the evaporator, the first heat including source heat from the first external source and the first residual heat. A risk of ice formation at or within the evaporator is reduced or eliminated due to the first residual heat transported by the medium to the evaporator. Further, the heat pump is configured to cycle therewithin a refrigerant between the evaporator and gas cooler, so that the first heat is transferred from the evaporator to the gas cooler, and from the gas cooler to the hot section of the STST proximate the first end by the second amount of the fluid, so as to be available to be further transferred to the heating load.

In at least some such embodiments, the refrigerant includes either carbon dioxide ($CO_2$) or another refrigerant suitable for use in a transcritical cycle, and the fluid is either first water or one or more of another fluid, another liquid, or one or more first gases. Further, the medium is either second water or one or more of a further fluid, a further liquid, or one or more second gases. Additionally, in at least some such embodiments, the system further comprises first and second additional conduits respectively coupled to the STST at the first additional location and second additional location, respectively, where the first and second additional locations are respectively at or proximate to the first and second ends, respectively, where the first output port of the gas cooler is coupled at least indirectly to the first additional location by the first additional conduit and the first input port of the first gas cooler is coupled to the second additional location at least indirectly by the second additional conduit, and where the refrigerant is the carbon dioxide ($CO_2$), the fluid is the first water, and the medium is the second water.

Also, in at least some such embodiments, a source return conduit is coupled at least indirectly to a first output port of the first evaporator, and the source return conduit is configured to at least indirectly communicate the second water, after the second water has passed through the evaporator, for receipt either by the first external source or a second external source. Further, in at least some such embodiments, the heat pump additionally includes a compressor and an expansion valve, where the compressor is coupled between a second output port of the evaporator and a second input port of the gas cooler, where the expansion valve is coupled between a second output port of the gas cooler and a second input port of the evaporator, where the first heat exchanger is a first external heat exchanger, where the second location is along the thermocline section. Additionally, the source return conduit is configured to at least indirectly communicate the medium, after the medium has passed through the first evaporator, for receipt either by the first external source, and the first external source is one of a waterway, a lake, a river, a geothermal heat source, or a waste heat source.

Additionally, in at least some such embodiments, the system further comprises a second external heat exchanger. A first input port of the second heat exchanger is coupled to the second additional location by way of the second additional conduit and a first output port of the second heat exchanger is coupled to the first input port of the gas cooler by way of a further intermediate conduit. A second input port of the second heat exchanger is coupled to the first output port of the evaporator by way of a third additional conduit, and a source return conduit is coupled to a second output port of the second heat exchanger, so that the second water, after exiting the evaporator, proceeds via the third additional conduit and through the second heat exchanger prior to passing through the source return conduit. Also, in at least some such embodiments, the second heat exchanger is configured to extract further heat from the first water and to transfer the further heat to the second water, so that a first temperature of the first water at the first input port of the gas cooler is less than a second temperature of the first water at the first input port of the second heat exchanger, and so that the first temperature of first water at the first input port is a level that is suitable for operation of the gas cooler and the compressor.

Further, in at least some such embodiments, the second heat exchanger is configured to extract second residual heat from the second water so that, when the second amount of the fluid flows out of the first output port of the second heat exchanger, the second amount of the fluid includes the second residual heat. Also, when the second amount of the fluid flows from the gas cooler via the first additional conduit to the hot section of the STST, the second amount of the fluid includes both the first heat and the second residual heat, whereby at least some of the second residual heat can be further transported by a further amount of the fluid via the first conduit for receipt by the heating load. Additionally, in at least some such embodiments, the system further includes a first mixing valve, where an input port of the first mixing valve is coupled to the second additional location by way of the second additional conduit, where a first output port of the first mixing valve is coupled to a first input port of a second heat exchanger, where each of a second output port of the first mixing valve and a first output port of the second heat exchanger are coupled to the first input port of the gas cooler, and where the first mixing valve can have a first actuation setting by which the second amount of fluid passes through the second heat exchanger and a second actuation setting by which the second amount of fluid bypasses the second heat exchanger.

Additionally, in at least some such embodiments, the system also comprises a second mixing valve, where an input port of the second mixing valve is configured to be coupled at least indirectly to the first external source so as to receive the medium, where a first output port of the second mixing valve is coupled to the second input port of the first heat exchanger, where each of a second output port of the second mixing valve and the second output port of the first heat exchanger are coupled to the first input port of the evaporator, and where the second mixing valve can have a first actuation setting by which the medium passes through the first heat exchanger and a second actuation setting by which the medium bypasses the first heat exchanger. Also, in at least some such embodiments, the system further comprises a third mixing valve, where an input port of the third mixing valve is coupled to the first output port of the evaporator, where a first output port of the third mixing valve is coupled to a second input port of the second heat exchanger, where each of a second output port of the third mixing valve and the second output port of the second heat exchanger are configured to be coupled, at least indirectly, to either the first external source or a second external source, and where the third mixing valve can have a first actuation setting by which the medium passes through the second heat exchanger and a second actuation setting by which the medium bypasses the second heat exchanger.

Further, in at least some such embodiments, the system also comprises third and fourth conduits respectively coupled to the STST at third and fourth locations, respectively, along the STST, where the fourth location is at or proximate to the second end of the STST and the third location is between the second and fourth locations, where the third and fourth conduits are configured to be coupled at least indirectly to a cooling load so that at least a third amount of the fluid can flow between the STST and the cooling load. Also, in at least some such embodiments, the system further comprises first and second pumps, where the first pump is arranged along the first conduit so that the first amount of the fluid is directed to flow through the first conduit away from the first location and through the second conduit toward the second location, and where the second pump is arranged along the further intermediate conduit so that the second amount of the fluid is directed to flow through the gas cooler. Additionally, in at least some embodiments, the system further comprises one or more of: (a) at least one part of a heating, ventilation, and air conditioning (HVAC) system including the heating load, where the heating load is a space heating load including a first heat exchanger; (b) a compressor coupled between the evaporator and the gas cooler, and an oil cooler coupled to the compressor and additionally coupled to the STST, so that additional heat can be extracted from the compressor via the oil cooler and returned to the STST; (c) a domestic hot water (DHW) system heat exchanger coupled at least indirectly to the STST; and (d) an outdoor cooler coupled at least indirectly to the STST.

Further, the present disclosure in at least some embodiments relates to a method of operating a heating and cooling system at least in part by performing water temperature conditioning. The method includes providing each of (a) a stratified thermal storage tank (STST) having an interior region and including within the interior region a fluid having a decreasing temperature distribution from a first end to a second end of the STST, (b) first and second conduits respectively coupled to the STST at a first location proximate the first end and at a second location along a midsection between the first and second ends, (c) first and second additional conduits respectively coupled to the STST at first and additional locations along the STST, respectively, where the first and second additional locations are respectively at or proximate to the first and second ends, respectively, (d) a first external heat exchanger, where the second conduit is coupled between the second location and a first output port of the first external heat exchanger, where a first intermediate conduit is coupled to a first input port of the first external heat exchanger and configured to be additionally coupled at least indirectly to the heating load, and where a second input port of the first external heat exchanger is configured to be coupled at least indirectly to a first external heat source, and (e) a heat pump including a first evaporator and a first gas cooler, where a first output port of the gas cooler is coupled to the STST at least indirectly by the first additional conduit and a first input port of the first gas cooler is coupled to the STST at least indirectly by the second additional conduit, and where a first input port of the first evaporator is coupled to a second output port of the first external heat exchanger by an additional intermediate conduit.

Additionally, the method also includes extracting residual heat from a first amount of fluid received at the first input port of the first heat exchanger at least indirectly from the heating load. Further, the method includes causing the medium to flow through the first heat exchanger from the second input port to the second output port thereof, and subsequently to the first input port of the first evaporator, so that the first evaporator receives first heat including both source heat included by the medium as provided by the first external source and also the residual heat. A risk of ice formation at or within the evaporator is reduced or eliminated due to the first residual heat. Also, the method includes transporting the first heat by way of flowing refrigerant within the heat pump from the evaporator to the gas cooler. Further, the method includes causing a second amount of the fluid to flow from the second additional location to the first additional location, via the second and first additional conduits and through the gas cooler, so that the second amount of the fluid receives the first heat at the gas cooler and so that the first heat is delivered to the interior of the STST by way of the first additional location. Additionally, the method includes pumping a further amount of the fluid to flow from the first location via the first conduit for receipt by the heating load, so that at least a portion of the first heat is delivered to the heating load.

Also, in at least some such embodiments, the providing additionally includes further providing a second external heat exchanger having a first input port that is coupled to the second additional location by way of the second additional conduit, a first output port that is coupled to the first input port of the gas cooler by way of a further intermediate conduit, a second input port that is coupled to the first output port of the first evaporator by way of an additional conduit, and a second output port coupled to a source return conduit. The second external heat exchanger is arranged relative to the first evaporator so that the medium, after exiting the first evaporator, proceeds via the additional conduit and through the second external heat exchanger prior to passing through the source return conduit. Additionally, in at least some such embodiments, the method further comprises extracting at the second external heat exchanger second residual heat from the medium received from the first evaporator at the second input port of the second external heat exchanger, and communicating the second residual heat within the second external heat exchanger so that the second amount of the fluid flowing out of the first output port of the second external heat exchanger includes the second residual heat. When the second amount of the fluid flows from the first gas cooler via the first additional conduit to the hot section of the interior region of the STST, the second amount of the fluid includes both the first heat and second residual heat, whereby at least some of the second residual heat can be further transported by the further amount of the fluid via the first conduit for receipt by the heating load.

Additionally, the present disclosure in at least some embodiments relates to a heating and cooling system configured to perform water temperature conditioning. The system includes a first stratified thermal storage tank (STST) having an interior region and including within the interior region a fluid having a decreasing temperature distribution from a first end to a second end of the at least one STST. The system also includes first and second conduits respectively coupled to the STST at a first location proximate the first end and at a second location within a thermocline section between the first and second ends, where the first and second conduits are configured to be coupled at least indirectly to a heating load so that a first amount of the fluid can flow between the STST and the heating load. Further, the system includes a first external heat exchanger, where the second conduit is coupled between the second location and a first output port of the first external heat exchanger, where a first intermediate conduit is coupled to a first input port of the first external heat exchanger and configured to be additionally coupled to the heating load so that the first amount of the fluid carrying first residual heat not absorbed by the heating load can be received by the first external heat exchanger, and where a second input port of the first external heat exchanger is configured to be coupled at least indirectly to a first external heat source to receive a medium.

Also, the system includes a heat pump including an evaporator and a gas cooler, where a first output port of the gas cooler is coupled to a first additional location proximate the first end at least indirectly by a first additional conduit, where a first input port of the first evaporator is coupled to a second output port of the first external heat exchanger by an additional intermediate conduit so as to receive the medium after the medium passes through the first external heat exchanger, and where the heat pump operates to circulate therewithin a refrigerant between the evaporator and the gas cooler in accordance with a transcritical cycle, so that first heat communicated by the medium received at the evaporator is transported to the gas cooler. The first heat communicated by the medium includes both source heat received from the first external heat source and the first residual heat extracted by the first heat exchanger, where the first heat is additionally communicated from the first output port of the gas cooler to the STST by a second amount of the fluid flowing through the first additional conduit so as to be available for further communication to the heating load. Additionally, a risk of ice formation at or within the evaporator is reduced or eliminated due to the first residual heat transferred by the medium.

Further, in at least some such embodiments, the system also comprises a second external heat exchanger. A first input port of the second external heat exchanger is coupled at least indirectly to a third location along the thermocline section of the STST, and a first output port of the second external heat exchanger is coupled at least indirectly to a first input port of the gas cooler. Also, a second input port of the second external heat exchanger is coupled to a first output port of the evaporator, and a second output port of the second external heat exchanger is coupled by a source return conduit at least indirectly to the first external heat source or another external heat source. Further, the second external heat exchanger operates to modify a temperature of the second amount of the fluid prior to the second amount of the fluid being provided to the first input port of the gas cooler. Additionally, in at least some such embodiments, the refrigerant includes carbon dioxide ($CO_2$), and the system further includes one or more of: a second STST coupled in series or in parallel with the first STST; or one or more mixing valves, where the one or more mixing valves at least partly govern one or more of (a) a first extent to which the second amount of the fluid passes through the second external heat exchanger, (b) a second extent to which the medium passes through the second external heat exchanger, and (c) a third extent to which the medium passes through the first external heat exchanger.

It is specifically intended that the present invention not be limited to the embodiments and illustrations contained herein, but include modified forms of those embodiments including portions of the embodiments and combinations of elements of different embodiments as come within the scope of the following claims.

We claim:

1. A heating and cooling system configured to perform water temperature conditioning, the heating and cooling system comprising:

a stratified thermal storage tank (STST) having an interior region extending between a first end and a second end, wherein the STST includes a plurality of portions of a fluid respectively having successively decreasing temperatures successively distributed from a hot section proximate the first end to a cold section proximate the second end;

first and second conduits respectively coupled to the STST at first and second locations, respectively, the first conduit also being configured to be coupled to a heating load;

a first heat exchanger, wherein the second conduit is coupled between the second location and a first output port of the first heat exchanger, and wherein a first intermediate conduit is coupled to a first input port of the first heat exchanger and configured to be coupled to the heating load, so that a first amount of the fluid can flow from the STST to the heating load and then to the first heat exchanger, and so that first residual heat carried by the first amount of the fluid and not absorbed by the heating load can be received by the heat exchanger;

a heat pump including an evaporator and a gas cooler, wherein a first output port and a first input port of the gas cooler are respectively coupled at least indirectly to first and second additional locations, respectively, along the STST, so that a second amount of the fluid can flow from the STST to and through the first gas cooler and then return to the STST, wherein a second input port of the first heat exchanger is configured to receive a medium from a first external source, and a second output port of the first heat exchanger is coupled to a first input port of the evaporator, so that the medium can flow from the first external source through the first heat exchanger and to the evaporator and transport first heat to the evaporator, the first heat including source heat from the first external source and the first residual heat, wherein a risk of ice formation at or within the evaporator is reduced or eliminated due to the first residual heat transported by the medium to the evaporator, and wherein the heat pump is configured to cycle therewithin a refrigerant between the evaporator and gas cooler, so that the first heat is transferred from the evaporator to the gas cooler, and from the gas cooler to the hot section of the STST proximate the first end by the second amount of the fluid, so as to be available to be further transferred to the heating load.

2. The heating and cooling system of claim 1, wherein the refrigerant includes either carbon dioxide ($CO_2$) or another refrigerant suitable for use in a transcritical cycle, wherein the fluid is either first water or one or more of another fluid, another liquid, or one or more first gases, and wherein the medium is either second water or one or more of a further fluid, a further liquid, or one or more second gases.

3. The heating and cooling system of claim 2, further comprising first and second additional conduits respectively coupled to the STST at the first additional location and second additional location, respectively, wherein the first and second additional locations are respectively at or proximate to the first and second ends, respectively, wherein the first output port of the gas cooler is coupled at least indirectly to the first additional location by the first additional conduit and the first input port of the first gas cooler is coupled to the second additional location at least indirectly by the second additional conduit, and wherein the refrigerant is the carbon dioxide ($CO_2$), wherein the fluid is the first water, and wherein the medium is the second water.

4. The heating and cooling system of claim 3, wherein a source return conduit is coupled at least indirectly to a first output port of the first evaporator, and wherein the source return conduit is configured to at least indirectly communicate the second water, after the second water has passed through the evaporator, for receipt either by the first external source or a second external source.

5. The heating and cooling system of claim 4, wherein the heat pump additionally includes a compressor and an expansion valve, wherein the compressor is coupled between a second output port of the evaporator and a second input port of the gas cooler, wherein the expansion valve is coupled between a second output port of the gas cooler and a second input port of the evaporator, wherein the first heat exchanger is a first external heat exchanger, wherein the second location is along the thermocline section, and wherein the source return conduit is configured to at least indirectly communicate the medium, after the medium has passed through the first evaporator, for receipt either by the first external source, and wherein the first external source is one of a waterway, a lake, a river, a geothermal heat source, or a waste heat source.

6. The heating and cooling system of claim 3, further comprising a second external heat exchanger, wherein a first input port of the second heat exchanger is coupled to the second additional location by way of the second additional conduit and a first output port of the second heat exchanger is coupled to the first input port of the gas cooler by way of a further intermediate conduit, wherein a second input port of the second heat exchanger is coupled to the first output port of the evaporator by way of a third additional conduit, and a source return conduit is coupled to a second output port of the second heat exchanger, so that the second water, after exiting the evaporator, proceeds via the third additional conduit and through the second heat exchanger prior to passing through the source return conduit.

7. The heating and cooling system of claim 6, wherein the second heat exchanger is configured to extract further heat from the first water and to transfer the further heat to the second water, so that a first temperature of the first water at the first input port of the gas cooler is less than a second temperature of the first water at the first input port of the second heat exchanger, and so that the first temperature of first water at the first input port is a level that is suitable for operation of the gas cooler and the compressor.

8. The heating and cooling system of claim 6, wherein the second heat exchanger is configured to extract second residual heat from the second water so that, when the second amount of the fluid flows out of the first output port of the second heat exchanger, the second amount of the fluid includes the second residual heat, and wherein, when the second amount of the fluid flows from the gas cooler via the first additional conduit to the hot section of the STST, the second amount of the fluid includes both the first heat and the second residual heat, whereby at least some of the second residual heat can be further transported by a further amount of the fluid via the first conduit for receipt by the heating load.

9. The heating and cooling system of claim 3, further comprising a first mixing valve, wherein an input port of the first mixing valve is coupled to the second additional location by way of the second additional conduit, wherein a first output port of the first mixing valve is coupled to a first input port of a second heat exchanger, wherein each of a second output port of the first mixing valve and a first output port of the second heat exchanger are coupled to the first input port of the gas cooler, and wherein the first mixing valve can have a first actuation setting by which the second amount of fluid passes through the second heat exchanger and a second actuation setting by which the second amount of fluid bypasses the second heat exchanger.

10. The heating and cooling system of claim 9, further comprising a second mixing valve, wherein an input port of the second mixing valve is configured to be coupled at least indirectly to the first external source so as to receive the medium, wherein a first output port of the second mixing valve is coupled to the second input port of the first heat exchanger, wherein each of a second output port of the second mixing valve and the second output port of the first heat exchanger are coupled to the first input port of the evaporator, and wherein the second mixing valve can have a first actuation setting by which the medium passes through the first heat exchanger and a second actuation setting by which the medium bypasses the first heat exchanger.

11. The heating and cooling system of claim 10, further comprising a third mixing valve, wherein an input port of the third mixing valve is coupled to the first output port of the evaporator, wherein a first output port of the third mixing valve is coupled to a second input port of the second heat exchanger, wherein each of a second output port of the third mixing valve and the second output port of the second heat exchanger are configured to be coupled, at least indirectly, to either the first external source or a second external source, and wherein the third mixing valve can have a first actuation setting by which the medium passes through the second heat exchanger and a second actuation setting by which the medium bypasses the second heat exchanger.

12. The heating and cooling system of claim 11, further comprising third and fourth conduits respectively coupled to the STST at third and fourth locations, respectively, along the STST, wherein the fourth location is at or proximate to the second end of the STST and the third location is between the second and fourth locations, wherein the third and fourth conduits are configured to be coupled at least indirectly to a cooling load so that at least a third amount of the fluid can flow between the STST and the cooling load.

13. The heating and cooling system of claim 12, further comprising first and second pumps, wherein the first pump is arranged along the first conduit so that the first amount of the fluid is directed to flow through the first conduit away from the first location and through the second conduit toward the second location, and wherein the second pump is arranged along the further intermediate conduit so that the second amount of the fluid is directed to flow through the gas cooler.

14. The heating and cooling system of claim 11, further comprising one or more of:

a) at least one part of a heating, ventilation, and air conditioning (HVAC) system including the heating load, wherein the heating load is a space heating load including a first heat exchanger;

b) a compressor coupled between the evaporator and the gas cooler, and an oil cooler coupled to the compressor and additionally coupled to the STST, so that additional heat can be extracted from the compressor via the oil cooler and returned to the STST;

c) a domestic hot water (DHW) system heat exchanger coupled at least indirectly to the STST; and d) an outdoor cooler coupled at least indirectly to the STST.

15. A method of operating a heating and cooling system at least in part by performing water temperature conditioning, the method comprising:

providing each of a) a stratified thermal storage tank (STST) having an interior region and including within the interior region a fluid having a decreasing temperature distribution from a first end to a second end of the STST, b) first and second conduits respectively coupled to the STST at a first location proximate the first end and at a second location along a midsection between the first and second ends, c) first and second additional conduits respectively coupled to the STST at first and additional locations along the STST, respectively, wherein the first and second additional locations are respectively at or proximate to the first and second ends, respectively, d) a first external heat exchanger, wherein the second conduit is coupled between the second location and a first output port of the first external heat exchanger, wherein a first intermediate conduit is coupled to a first input port of the first external heat exchanger and configured to be additionally coupled at least indirectly to the heating load, and wherein a second input port of the first external heat exchanger is configured to be coupled at least indirectly to a first external heat source, and e) a heat pump including a first evaporator and a first gas cooler, wherein a first output port of the gas cooler is coupled to the STST at least indirectly by the first additional conduit and a first input port of the first gas cooler is coupled to the STST at least indirectly by the second additional conduit, and wherein a first input port of the first evaporator is coupled to a second output port of the first external heat exchanger by an additional intermediate conduit;

extracting residual heat from a first amount of fluid received at the first input port of the first heat exchanger at least indirectly from the heating load;

causing the medium to flow through the first heat exchanger from the second input port to the second output port thereof, and subsequently to the first input port of the first evaporator, so that the first evaporator receives first heat including both source heat included by the medium as provided by the first external source and also the residual heat, wherein a risk of ice formation at or within the evaporator is reduced or eliminated due to the first residual heat;

transporting the first heat by way of flowing refrigerant within the heat pump from the evaporator to the gas cooler;

causing a second amount of the fluid to flow from the second additional location to the first additional location, via the second and first additional conduits and through the gas cooler, so that the second amount of the fluid receives the first heat at the gas cooler and so that the first heat is delivered to the interior of the STST by way of the first additional location; and pumping a further amount of the fluid to flow from the first location via the first conduit for receipt by the heating load, so that at least a portion of the first heat is delivered to the heating load.

16. The method of claim 15, wherein the providing additionally includes further providing a second external heat exchanger having a first input port that is coupled to the second additional location by way of the second additional conduit, a first output port that is coupled to the first input port of the gas cooler by way of a further intermediate conduit, a second input port that is coupled to the first output port of the first evaporator by way of an additional conduit, and a second output port coupled to a source return conduit; and wherein the second external heat exchanger is arranged relative to the first evaporator so that the medium, after exiting the first evaporator, proceeds via the additional conduit and through the second external heat exchanger prior to passing through the source return conduit.

17. The method of claim 16, further comprising:

extracting at the second external heat exchanger second residual heat from the medium received from the first evaporator at the second input port of the second external heat exchanger;

communicating the second residual heat within the second external heat exchanger so that the second amount of the fluid flowing out of the first output port of the second external heat exchanger includes the second residual heat, wherein, when the second amount of the fluid flows from the first gas cooler via the first additional conduit to the hot section of the interior region of the STST, the second amount of the fluid includes both the first heat and second residual heat, whereby at least some of the second residual heat can be further transported by the further amount of the fluid via the first conduit for receipt by the heating load.

18. A heating and cooling system configured to perform water temperature conditioning, the heating and cooling system comprising:

a first stratified thermal storage tank (STST) having an interior region and including within the interior region a fluid having a decreasing temperature distribution from a first end to a second end of the at least one STST;

first and second conduits respectively coupled to the STST at a first location proximate the first end and at a second location within a thermocline section between the first and second ends, wherein the first and second conduits are configured to be coupled at least indirectly to a heating load so that a first amount of the fluid can flow between the STST and the heating load;

a first external heat exchanger, wherein the second conduit is coupled between the second location and a first output port of the first external heat exchanger, wherein a first intermediate conduit is coupled to a first input port of the first external heat exchanger and configured to be additionally coupled to the heating load so that the first amount of the fluid carrying first residual heat not absorbed by the heating load can be received by the first external heat exchanger, and wherein a second input port of the first external heat exchanger is configured to be coupled at least indirectly to a first external heat source to receive a medium;

a heat pump including an evaporator and a gas cooler, wherein a first output port of the gas cooler is coupled to a first additional location proximate the first end at least indirectly by a first additional conduit, wherein a first input port of the first evaporator is coupled to a second output port of the first external heat exchanger by an additional intermediate conduit so as to receive the medium after the medium passes through the first external heat exchanger, wherein the heat pump operates to circulate therewithin a refrigerant between the evaporator and the gas cooler in accordance with a transcritical cycle, so that first heat communicated by the medium received at the evaporator is transported to the gas cooler, wherein the first heat communicated by the medium includes both source heat received from the first external heat source and the first residual heat extracted by the first heat exchanger, wherein the first heat is additionally communicated from the first output port of the gas cooler to the STST by a second amount of the fluid flowing through the first additional conduit so as to be available for further communication to the heating load, and wherein a risk of ice formation at or within the evaporator is reduced or eliminated due to the first residual heat transferred by the medium.

19. The heating and cooling system of claim 18, further comprising:

a second external heat exchanger, wherein a first input port of the second external heat exchanger is coupled at least indirectly to a third location along the thermocline section of the STST, wherein a first output port of the second external heat exchanger is coupled at least indirectly to a first input port of the gas cooler, wherein a second input port of the second external heat exchanger is coupled to a first output port of the evaporator, and wherein a second output port of the second external heat exchanger is coupled by a source return conduit at least indirectly to the first external heat source or another external heat source, wherein the second external heat exchanger operates to modify a temperature of the second amount of the fluid prior to the second amount of the fluid being provided to the first input port of the gas cooler.

20. The heating and cooling system of claim 19, wherein the refrigerant includes carbon dioxide ($CO_2$), further comprising one or more of:

a second STST coupled in series or in parallel with the first STST; or one or more mixing valves, wherein the one or more mixing valves at least partly govern one or more of (a) a first extent to which the second amount of the fluid passes through the second external heat exchanger, (b) a second extent to which the medium passes through the second external heat exchanger, and (c) a third extent to which the medium passes through the first external heat exchanger.

* * * * *